US009997103B2

(12) United States Patent
Jin et al.

(10) Patent No.: US 9,997,103 B2
(45) Date of Patent: Jun. 12, 2018

(54) DISPLAY SUBSTRATE, DRIVING METHOD THEREOF AND DISPLAY DEVICE

(71) Applicant: BOE TECHNOLOGY GROUP CO., LTD., Beijing (CN)

(72) Inventors: Xiaodan Jin, Beijing (CN); Lintao Zhang, Beijing (CN)

(73) Assignee: BOE Technologgy Group Co., Ltd., Beijing (CN)

( * ) Notice: Subject to any disclaimer, the term of this patent is extended or adjusted under 35 U.S.C. 154(b) by 149 days.

(21) Appl. No.: 14/913,557

(22) PCT Filed: Jul. 22, 2015

(86) PCT No.: PCT/CN2015/084780
§ 371 (c)(1),
(2) Date: Feb. 22, 2016

(87) PCT Pub. No.: WO2016/127584
PCT Pub. Date: Aug. 18, 2016

(65) Prior Publication Data

US 2016/0358540 A1 Dec. 8, 2016

(30) Foreign Application Priority Data

Feb. 13, 2015 (CN) ..... 2015 1 0079890

(51) Int. Cl.
*G09G 3/30* (2006.01)
*G09G 3/3208* (2016.01)
(Continued)

(52) U.S. Cl.
CPC ..... *G09G 3/3208* (2013.01); *G09G 3/2003* (2013.01); *G09G 3/3607* (2013.01); *G09G 3/3611* (2013.01); *G09G 2300/0452* (2013.01)

(58) Field of Classification Search
USPC ..... 345/76
See application file for complete search history.

(56) References Cited

U.S. PATENT DOCUMENTS 8,552,635 B2 10/2013 Kim et al.
8,754,913 B2 6/2014 Hwang et al.
(Continued)

FOREIGN PATENT DOCUMENTS

CN 102262854 A 11/2011
CN 103714751 A 4/2014
(Continued)

OTHER PUBLICATIONS

International Search Report of PCT/CN2015/084780 in Chinese, dated Nov. 24, 2015 with English translation.
(Continued)

*Primary Examiner* — Joseph Haley
*Assistant Examiner* — Chineyere Wills-Burns
(74) *Attorney, Agent, or Firm* — Collard & Roe, P.C.

(57) ABSTRACT

A display substrate, a driving method thereof and a display device are disclosed. The display substrate includes repeatedly arranged pixel groups. Each pixel group includes a first sub-pixel group, a second sub-pixel group, a third sub-pixel group and a fourth sub-pixel group. Each of the first sub-pixel group, the second sub-pixel group, the third sub-pixel group and the fourth sub-pixel group includes four pixel columns. The display substrate, the driving method thereof and the display device reduce the number of sub-pixels in the whole display device and hence reduce the difficulty in the manufacturing process of the display device and the cost on the premise of ensuring that the display device obtains a high resolution.

19 Claims, 2 Drawing Sheets

(51) Int. Cl.
*G09G 3/36* (2006.01)
*G09G 3/20* (2006.01)

(56) References Cited

U.S. PATENT DOCUMENTS

| | | | | |
|---|---|---|---|---|
| 9,224,334 | B2 | 12/2015 | Izumi et al. | |
| 9,262,957 | B2 | 2/2016 | Yang et al. | |
| 9,262,961 | B2 | 2/2016 | Shih et al. | |
| 9,437,128 | B2 | 9/2016 | Yang et al. | |
| 2003/0128225 | A1 | 7/2003 | Credelle et al. | |
| 2004/0080479 | A1 | 4/2004 | Credelle | |
| 2005/0168423 | A1 | 8/2005 | Hirata et al. | |
| 2007/0205423 | A1 | 9/2007 | Yamazaki et al. | |
| 2010/0118045 | A1* | 5/2010 | Brown Elliott | G02B 27/2214 345/589 |
| 2011/0291549 | A1 | 12/2011 | Kim et al. | |
| 2012/0262362 | A1 | 10/2012 | Uehara et al. | |
| 2013/0106891 | A1 | 5/2013 | Matsueda et al. | |
| 2014/0198479 | A1 | 7/2014 | Chao et al. | |
| 2014/0204008 | A1* | 7/2014 | Chu-Ke | G09G 3/2003 345/88 |
| 2015/0116375 | A1* | 4/2015 | Yang | G09G 3/2003 345/690 |
| 2015/0309360 | A1 | 10/2015 | Wang et al. | |
| 2015/3002808 | | 10/2015 | Wang et al. | |
| 2015/0364075 | A1 | 12/2015 | Sato et al. | |
| 2016/0027358 | A1 | 1/2016 | Guo et al. | |
| 2016/0117982 | A1* | 4/2016 | Fujii | G09G 3/3225 345/211 |
| 2016/0155397 | A1* | 6/2016 | Yang | G09G 3/3607 345/87 |
| 2016/0171917 | A1 | 6/2016 | Yang et al. | |
| 2016/0358540 | A1 | 12/2016 | Jin et al. | |
| 2016/0372019 | A1* | 12/2016 | Jin | G09G 3/20 |
| 2016/0372020 | A1 | 12/2016 | Jin et al. | |

FOREIGN PATENT DOCUMENTS

| | | | |
|---|---|---|---|
| CN | 104009063 | A | 8/2014 |
| CN | 104009064 | A | 8/2014 |
| CN | 104009066 | A | 8/2014 |
| CN | 104166260 | A | 11/2014 |
| CN | 104599599 | A | 5/2015 |
| CN | 104614882 | A | 5/2015 |
| CN | 104616597 | A | 5/2015 |
| JP | 2006-018090 | A | 1/2006 |
| KR | 10-2011-0117612 | A | 10/2011 |
| KR | 10-2014-0116805 | A | 10/2014 |
| WO | 2007/034618 | A1 | 3/2007 |

OTHER PUBLICATIONS

Notice of Transmittal of the International Search Report of PCT/CN2015/084780 in Chinese, dated Nov. 24, 2015.

Written Opinion of the International Searching Authority of PCT/CN2015/084780 in Chinese, dated Nov. 24, 2015 with English translation.

English translation of the International Preliminary Report on Patentability and Written Opinion of the International Searching Authority of PCT/CN2015/084780, dated Aug. 15, 2017.

International Search Report of PCT/CN2015/084285 in Chinese, dated Nov. 11, 2015 with English translation.

Notice of Transmittal of the International Search Report of PCT/CN2015/084285 in Chinese, dated Nov. 11, 2015.

Written Opinion of the International Searching Authority of PCT/CN2015/084285 in Chinese, dated Nov. 11, 2015 with English translation.

Chinese Office Action in Chinese Application No. 201510079588.9 dated Feb. 27, 2017 with English translation.

Non-Final U.S. Office Action in U.S. Appl. No. 14/905,371 dated Apr. 19, 2017.

English translation of the International Preliminary Report on Patentability and Written Opinion of the International Searching Authority of PCT/CN2015/084285, dated Aug. 15, 2017.

* cited by examiner

DISPLAY SUBSTRATE, DRIVING METHOD THEREOF AND DISPLAY DEVICE

CROSS REFERENCE TO RELATED APPLICATIONS

This application is the National Stage of PCT/CN2015/084780 filed on Jul. 22, 2015, which claims priority under 35 U.S.C. § 119 of Chinese Application No. 201510079890.4 filed on Feb. 13, 2015, the disclosure of which is incorporated by reference.

TECHNICAL FIELD

Embodiments of the present disclosure relate to a display substrate, a driving method thereof and a display device.

BACKGROUND

A traditional display device involves that: sub-pixels of three colors, namely red, green and blue (RGB), are combined to form a pixel for display. In actual application, the resolution of a display device can be improved by increasing the pixels per inch (PPI) of the display device. Currently, RG/BG is the most commonly used pixel arrangement mode using less sub-pixels for achieving high resolution. But along with the requirement on the resolution of the display device being higher, the RG/BG sub-pixel arrangement mode also faces great challenge. In order to achieve the objective of improving the resolution of the display device, the number of the sub-pixels must be increased. Thus, the display device will have large difficulty in manufacturing process and suffers from high cost.

SUMMARY

At least one embodiment of the present disclosure provides a display device, a driving method thereof and a display device, which are used for reducing the difficulty in the manufacturing process of the display device and reducing the cost.

At least one embodiment of the present disclosure provides a display substrate, comprising repeatedly arranged pixel groups, wherein each pixel group includes a first sub-pixel group, a second sub-pixel group, a third sub-pixel group and a fourth sub-pixel group; each of the first sub-pixel group, the second sub-pixel group, the third sub-pixel group and the fourth sub-pixel group includes four pixel columns; the first pixel column in the first sub-pixel group is provided with a first sub-pixel; two second sub-pixels in the second pixel column of the first sub-pixel group are arranged in sequence; the third pixel column in the first sub-pixel group is provided with a third sub-pixel; the fourth pixel column in the first sub-pixel group is provided with a second sub-pixel, in which both the first sub-pixel in the first pixel column and the second sub-pixel in the fourth pixel column correspond the two second sub-pixels in the second pixel column; two first sub-pixels in the first pixel column of the second sub-pixel group are arranged in sequence; two second sub-pixels in the second pixel column of the second sub-pixel group are arranged in sequence; the third pixel column in the second sub-pixel group is provided with a third sub-pixel; the fourth pixel column in the second sub-pixel group is provided with a second sub-pixel, in which both the third sub-pixel in the third pixel column and the second sub-pixel in the fourth pixel column correspond to the two second sub-pixels in the second pixel column; the first pixel column in the third sub-pixel group is provided with third sub-pixels; the second pixel column in the third sub-pixel group is provided with a second sub-pixel; the third pixel column in the third sub-pixel group is provided with a first sub-pixel; two second sub-pixels in the fourth pixel column of the third sub-pixel group are arranged in sequence, in which both the second sub-pixel in the second pixel column and the first sub-pixel in the third pixel column correspond to the two second sub-pixels in the fourth pixel column; the first pixel column in the fourth sub-pixel group is provided with a third sub-pixel; the second pixel column in the fourth sub-pixel group is provided with a second sub-pixel; two first sub-pixels in the third pixel column of the fourth sub-pixel group are arranged in sequence; and two second sub-pixels in the fourth pixel column of the fourth sub-pixel group are arranged in sequence, in which both the third sub-pixel in the first pixel column and the second sub-pixel in the second pixel column correspond to the two first sub-pixels in the third pixel column.

For example, the first sub-pixel group and the second sub-pixel group are arranged side by side; the third sub-pixel group and the fourth sub-pixel group are arranged side by side; the pixel columns in the first sub-pixel group correspond to the pixel columns in the third sub-pixel group; and the pixel columns in the second sub-pixel group correspond to the pixel columns in the fourth sub-pixel group.

For example, the third pixel column in the first sub-pixel group is provided with one third sub-pixel, and the third sub-pixel in the third pixel column of the first sub-pixel group corresponds to the two second sub-pixels in the second pixel column; or the third pixel column in the first sub-pixel group is provided with two third sub-pixels.

For example, when the third pixel column in the first sub-pixel group is provided with one third sub-pixel, the first sub-pixel in the first pixel column, the third sub-pixel in the third pixel column and the second sub-pixel in the fourth pixel column of the first sub-pixel group are arranged in a same pixel row as the third sub-pixel in the third pixel column and the second sub-pixel in the fourth pixel column of the second sub-pixel group; and when the third pixel column of the first sub-pixel group is provided with two third sub-pixels, the first sub-pixel in the first pixel column and the second sub-pixel in the fourth pixel column of the first sub-pixel group are arranged in a same pixel row as the third sub-pixel in the third pixel column and the second sub-pixel in the fourth pixel column of the second sub-pixel group.

For example, the first pixel column in the third sub-pixel group is provided with one third sub-pixel, and the first sub-pixel in the third pixel column of the third sub-pixel group corresponds to the two second sub-pixels in the second pixel column; or the first pixel column in the third sub-pixel group is provided with two third sub-pixels.

For example, when the first pixel column in the third sub-pixel group is provided with one third sub-pixel, the third sub-pixel in the first pixel column, the second sub-pixel in the second pixel column and the first sub-pixel in the third pixel column of the third sub-pixel group are arranged in a same pixel row as the third sub-pixel in the first pixel column and the second sub-pixel in the second pixel column of the fourth sub-pixel group; or when the first pixel column in the third sub-pixel group is provided with two third sub-pixels, the second sub-pixel in the second pixel column and the first sub-pixel in the third pixel column of the third sub-pixel group arranged in a same pixel row as the third sub-pixel in the first pixel column and the second sub-pixel in the second pixel column of the fourth sub-pixel group.

At least one embodiment of the present disclosure provides a display device, comprising any of the above-mentioned the display substrates.

At least one embodiment of the present disclosure provides a method for driving a display substrate for driving the display substrate according to claim 1, comprising: generating an output value of the first sub-pixel in the first pixel column, output values of two second sub-pixels in the second pixel column, output values of the third sub-pixel in the third pixel column, and an output value of a second sub-pixel in the fourth pixel column of the first sub-pixel group, and outputting the output value of the first sub-pixel in the first pixel column, the output values of the two second sub-pixels in the second pixel column, the output values of the third sub-pixel in the third pixel column, and the output value of the second sub-pixel in the fourth pixel column of the first sub-pixel group; generating output values of two first sub-pixels in the first pixel column, output values of two second sub-pixels in the second pixel column, an output value of the third sub-pixel in the third pixel column, and an output value of the second sub-pixel in the fourth pixel column of the second sub-pixel group, and outputting the output value of the two first sub-pixels in the first pixel column, the output values of the two second sub-pixels in the second pixel column, the output value of the third sub-pixel in the third pixel column and the output value of the second sub-pixel in the fourth pixel column of the second sub-pixel group; generating output values of third sub-pixels in the first pixel column, an output value of the second sub-pixel in the second pixel column, an output value of the first sub-pixel in the third pixel column, and output values of two second sub-pixels in the fourth pixel column of the third sub-pixel group, and outputting the output values of the third sub-pixels in the first pixel column, the output value of the second sub-pixel in the second pixel column, the output value of the first sub-pixel in the third pixel column, and the output values of the two second sub-pixels in the fourth pixel column of the third sub-pixel group; and generating an output value of the third sub-pixel in the first pixel column, an output value of the second sub-pixel in the second pixel column, an output value of two first sub-pixels in the third pixel column, and output values of two second sub-pixels in the fourth pixel column of the fourth sub-pixel group, and outputting the output value of the third sub-pixel in the first pixel column, the output value of the second sub-pixel in the second pixel column, the output value of the two first sub-pixels in the third pixel column, and the output values of the two second sub-pixels in the fourth pixel column of the fourth sub-pixel group.

For example, the step of generating the output value of the first sub-pixel in the first pixel column, the output values of the two second sub-pixels in the second pixel column, the output values of the third sub-pixels in the third pixel column and the output value of the second sub-pixel in the fourth pixel column of the first sub-pixel group includes: generating the output value of the first sub-pixel in the first pixel column according to input values of four first sub-pixels corresponding to the first sub-pixel in the first pixel column of the first sub-pixel group; generating the output value of each second sub-pixel in the second pixel column according to the input value of the second sub-pixel corresponding to each second sub-pixel in the second pixel column of the first sub-pixel group; when the third pixel column in the first sub-pixel group is provided with one third sub-pixel, generating the output value of the third sub-pixel in the third pixel column according to input values of four third sub-pixels corresponding to the third sub-pixel in the third pixel column; or when the third pixel column in the first sub-pixel group is provided with two third sub-pixels, generating the output value of the third sub-pixel in the third pixel column according to input values of two third sub-pixels corresponding to the third sub-pixels in the third pixel column; and generating the output value of the second sub-pixel in the fourth pixel column according to input values of two second sub-pixels corresponding to the second sub-pixel in the fourth pixel column of the first sub-pixel group.

For example, the step of generating the output value of the first sub-pixel in the first pixel column according to the input values of the four first sub-pixels corresponding to the first sub-pixel in the first pixel column of the first sub-pixel group includes: generating the output value of the first sub-pixel in the first pixel column by dividing, by four, a sum of the input values of the four first sub-pixels corresponding to the first sub-pixel in the first pixel column of the first sub-pixel group; the step of generating the output value of each second sub-pixel in the second pixel column according to the input value of the second sub-pixel corresponding to each second sub-pixel in the second pixel column of the first sub-pixel group includes: setting the input value of the second sub-pixel corresponding to each second sub-pixel in the second pixel column of the first sub-pixel group to be the output value of each second sub-pixel in the second pixel column; the step of generating the output value of the third sub-pixel in the third pixel column according to the input values of the four third sub-pixels corresponding to the third sub-pixel in the third pixel column, when the third pixel column in the first sub-pixel group is provided with one third sub-pixel, includes: generating the output value of the third sub-pixel in the third pixel column by dividing, by four, a sum of the input values of the four third sub-pixels corresponding to the third sub-pixel in the third pixel column; or the step of generating the output value of the third sub-pixel in the third pixel column according to the input values of the two third sub-pixels corresponding to the third sub-pixel in the third pixel column, when the third pixel column in the first sub-pixel group is provided with two third sub-pixels, includes: generating the output value of the third sub-pixel in the third pixel column by dividing, by two, a sum of the input values of the two third sub-pixels corresponding to the third sub-pixel in the third pixel column; and the step of generating the output value of the second sub-pixel in the fourth pixel column according to the input values of the two second sub-pixels corresponding to the second sub-pixel in the fourth pixel column of the first sub-pixel group includes: generating the output value of the second sub-pixel in the fourth pixel column by dividing, by two, a sum of the input values of the two second sub-pixels corresponding to the second sub-pixel in the fourth pixel column of the first sub-pixel group.

For example, the step of generating the output value of the two first sub-pixels in the first pixel column, the output values of the two second sub-pixels in the second pixel column, the output value of the third sub-pixel in the third pixel column and the output value of the second sub-pixel in the fourth pixel column of the second sub-pixel group includes: generating the output value of each first sub-pixel in the first pixel column according to input values of two first sub-pixels corresponding to each first sub-pixel in the first pixel column of the second sub-pixel group; generating the output value of each second sub-pixel in the second pixel column according to an input value of a second sub-pixel corresponding to each second sub-pixel in the second pixel column of the second sub-pixel group; generating the output value of the third sub-pixel in the third pixel column according to input values of four third sub-pixels corresponding to the third sub-pixel in the third pixel column of the second sub-pixel group; and generating the output value of the second sub-pixel in the fourth pixel column according to input values of two second sub-pixels corresponding to the second sub-pixel in the fourth pixel column of the second sub-pixel group.

For example, the step of generating the output value of each first sub-pixel in the first pixel column according to the input values of the two first sub-pixels corresponding to each first sub-pixel in the first pixel column of the second sub-pixel group includes: generating the output value of each first sub-pixel in the first pixel column by dividing, by two, a sum of the input values of the two first sub-pixels corresponding to each first sub-pixel in the first pixel column of the second sub-pixel group; the step of generating the output value of each second sub-pixel in the second pixel column according to the input value of the second sub-pixel corresponding to each second sub-pixel in the second pixel column of the second sub-pixel group includes: setting the input value of the second sub-pixel corresponding to each second sub-pixel in the second pixel column of the second sub-pixel group to be the output value of each second sub-pixel in the second pixel column; the step of generating the output value of the third sub-pixel in the third pixel column according to the input values of the four third sub-pixels corresponding to the third sub-pixel in the third pixel column of the second sub-pixel group includes: generating the output value of the third sub-pixel in the third pixel column by dividing, by four, a sum of the input values of the four third sub-pixels corresponding to the third sub-pixel in the third pixel column of the second sub-pixel group; and the step of generating the output value of the second sub-pixel in the fourth pixel column according to the input values of the two second sub-pixels corresponding to the second sub-pixel in the fourth pixel column of the second sub-pixel group includes: generating the output value of the second sub-pixel in the fourth pixel column by dividing, by two, a sum of the input values of the two second sub-pixels corresponding to the second sub-pixel in the fourth pixel column of the second sub-pixel group.

For example, the step of generating the output values of the third sub-pixels in the first pixel column, the output value of the second sub-pixel in the second pixel column, the output value of the first sub-pixel in the third pixel column and the output values of the two second sub-pixels in the fourth pixel column of the third sub-pixel group includes: when the first pixel column in the third sub-pixel group is provided with one third sub-pixel, generating the output value of the third sub-pixel in the first pixel column according to input values of four third sub-pixels corresponding to the third sub-pixel in the first pixel column; or when the first pixel column in the third sub-pixel group is provided with two third sub-pixels, generating the output value of the third sub-pixel in the first pixel column according to input values of two third sub-pixels corresponding to the third sub-pixel in the first pixel column; generating the output value of the second sub-pixel in the second pixel column according to input values of two second sub-pixels corresponding to the second sub-pixel in the second pixel column of the third sub-pixel group; generating the output value of the first sub-pixel in the third pixel column according to input values of four first sub-pixels corresponding to the first sub-pixel in the third pixel column of the third sub-pixel group; and generating the output value of each second sub-pixel in the fourth pixel column according to an input value of a second sub-pixel corresponding to each second sub-pixel in the fourth pixel column of the third sub-pixel group.

For example, the step of generating the output value of the third sub-pixel in the first pixel column according to the input values of the four third sub-pixels corresponding to the third sub-pixel in the first pixel column, when the first pixel column in the third sub-pixel group is provided with one third sub-pixel, includes: generating the output value of the third sub-pixel in the first pixel column by dividing, by four, a sum of the input values of the four third sub-pixels corresponding to the third sub-pixel in the first pixel column; or the step of generating the output value of the third sub-pixel in the first pixel column according to the input values of the two third sub-pixels corresponding to the third sub-pixel in the first pixel column, when the third pixel column in the third sub-pixel group is provided with two third sub-pixels, includes: generating the output value of the third sub-pixel in the first pixel column by dividing, by two, a sum of the input values of the two third sub-pixels corresponding to the third sub-pixel in the first pixel column; the step of generating the output value of the second sub-pixel in the second pixel column according to the input values of the two second sub-pixels corresponding to the second sub-pixel in the second pixel column of the third sub-pixel group includes: generating the output value of the second sub-pixel in the second pixel column by dividing, by two, a sum of the input values of the two second sub-pixels corresponding to the second sub-pixel in the second pixel column of the third sub-pixel group; the step of generating the output value of the first sub-pixel in the third pixel column according to the input values of the four first sub-pixels corresponding to the first sub-pixel in the third pixel column of the third sub-pixel group includes: generating the output value of the first sub-pixel in the third pixel column by dividing, by four, a sum of the input values of the four first sub-pixels corresponding to the first sub-pixel in the third pixel column of the third sub-pixel group; and the step of generating the output value of each second sub-pixel in the fourth pixel column according to the input value of the second sub-pixel corresponding to each second sub-pixel in the fourth pixel column of the third sub-pixel group includes: setting the input value of the second sub-pixel corresponding to each second sub-pixel in the fourth pixel column of the third sub-pixel group to be the output value of each second sub-pixel in the fourth pixel column.

For example, the step of generating the output value of the third sub-pixel in the first pixel column, the output value of the second sub-pixel in the second pixel column, the output value of the two first sub-pixels in the third pixel column and the output values of the two second sub-pixels in the fourth pixel column of the fourth sub-pixel group includes: generating the output value of the third sub-pixel in the first pixel column according to input values of four third sub-pixels corresponding to the third sub-pixel in the first pixel column of the fourth sub-pixel group; generating the output value of the second sub-pixel in the second pixel column according to input values of two second sub-pixels corresponding to the second sub-pixel in the second pixel column of the fourth sub-pixel group; generating the output value of each first sub-pixel in the third pixel column according to input values of four first sub-pixels corresponding to each first sub-pixel in the third pixel column of the fourth sub-pixel group; and generating the output value of each second sub-pixel in the fourth pixel column according to an input value of a second sub-pixel corresponding to each second sub-pixel in the fourth pixel column of the fourth sub-pixel group.

For example, the step of generating the output value of the third sub-pixel in the first pixel column according to the input values of the four third sub-pixels corresponding to the third sub-pixel in the first pixel column of the fourth sub-pixel group includes: generating the output value of the third sub-pixel in the first pixel column by dividing, by four, a sum of the input values of the four third sub-pixels corresponding to the third sub-pixel in the first pixel column of the fourth sub-pixel group; the step of generating the output value of the second sub-pixel in the second pixel column according to the input values of the two second sub-pixels corresponding to the second sub-pixel in the second pixel column of the fourth sub-pixel group includes: generating the output value of the second sub-pixel in the second pixel column by dividing, by two, a sum of the input values of the two second sub-pixels corresponding to the second sub-pixel in the second pixel column of the fourth sub-pixel group; the step of generating the output value of each first sub-pixel in the third pixel column according to the input values of the four first sub-pixels corresponding to each first sub-pixel in the third pixel column of the fourth sub-pixel group includes: generating the output value of each first sub-pixel in the third pixel column by dividing, by four, a sum of the input values of the four first sub-pixels corresponding to each first sub-pixel in the third pixel column of the fourth sub-pixel group; and the step of generating the output value of each second sub-pixel in the fourth pixel column according to the input value of the second sub-pixel corresponding to each second sub-pixel in the fourth pixel column of the fourth sub-pixel group includes: setting the input value of the second sub-pixel corresponding to each second sub-pixel in the fourth pixel column of the fourth sub-pixel group to be the output value of each second sub-pixel in the fourth pixel column.

BRIEF DESCRIPTION OF THE DRAWINGS

Simple description will be given below to the accompanying drawings of the embodiments to provide a more clear understanding of the technical proposals of the embodiments of the present disclosure. Obviously, the drawings described below only involve some embodiments of the present disclosure but are not intended to limit the present disclosure.

DETAILED DESCRIPTION

For more clear understanding of the objectives, technical proposals and advantages of the embodiments of the present disclosure, clear and complete description will be given below to the technical proposals of the embodiments of the present disclosure with reference to the accompanying drawings of the embodiments of the present disclosure. Obviously, the preferred embodiments are only partial embodiments of the present disclosure but not all the embodiments. All the other embodiments obtained by those skilled in the art without creative efforts on the basis of the embodiments of the present disclosure illustrated shall fall within the scope of protection of the present disclosure.

Figure 1:
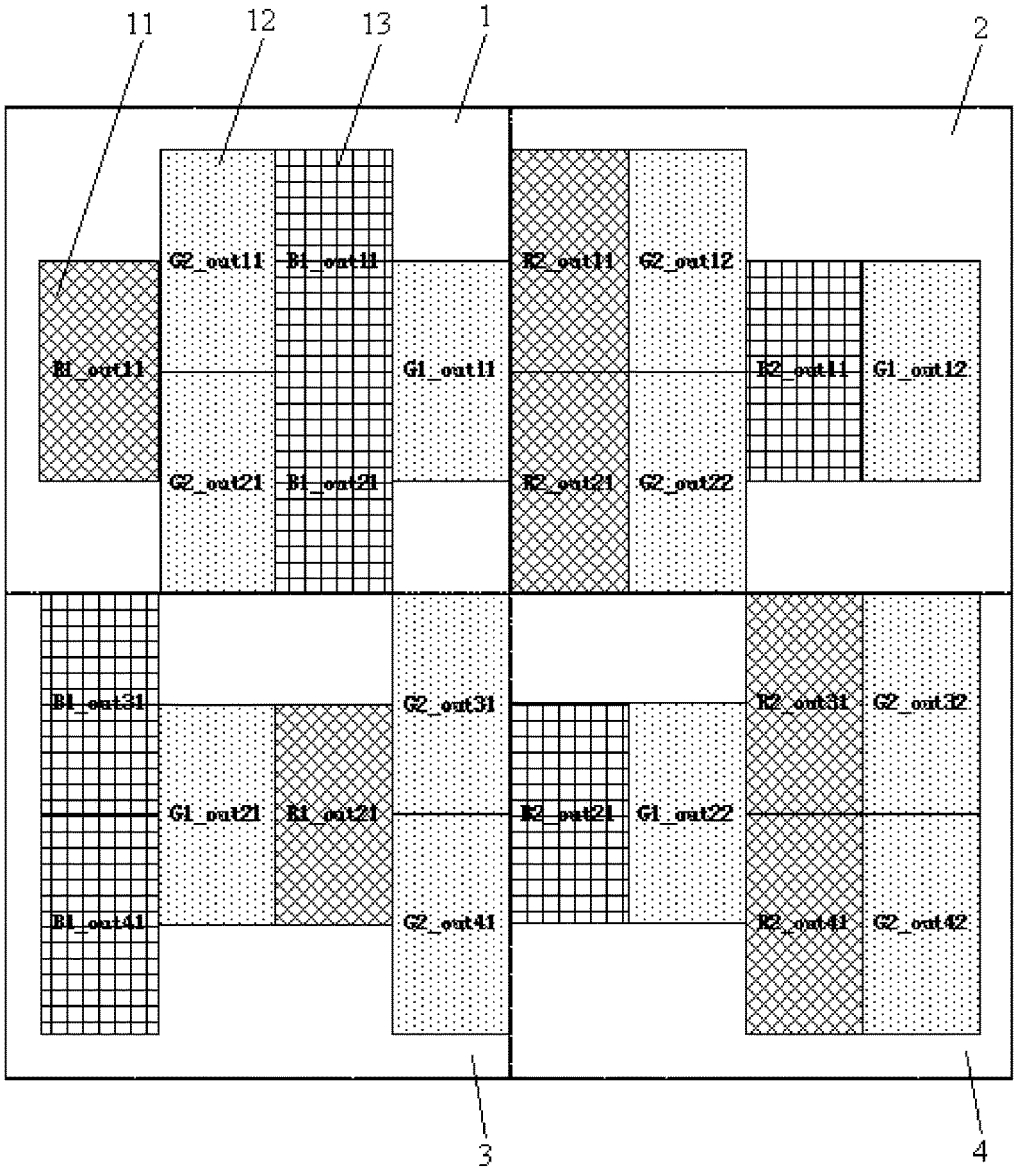
FIG. 1 is a schematic partial structural view of a display substrate provided by a first embodiment of the present disclosure.

FIG. 1 is a schematic partial structural view of a display substrate provided by a first embodiment of the present disclosure. As illustrated in FIG. 1, the display substrate comprises repeatedly arranged pixel groups. Each pixel group includes a first sub-pixel group 1, a second sub-pixel group 2, a third sub-pixel group 3 and a fourth sub-pixel group 4. Each of the first sub-pixel group 1, the second sub-pixel group 2, the third sub-pixel group 3 and the fourth sub-pixel group 4 includes four pixel columns.

The first pixel column in the first sub-pixel group 1 is provided with a first sub-pixel 11; two second sub-pixels 12 in the second pixel column of the first sub-pixel group 1 are arranged in sequence; the third pixel column in the first sub-pixel group 1 is provided with third sub-pixels 13; and the fourth pixel column in the first sub-pixel group 1 is provided with a second sub-pixel 12. Both the first sub-pixel 11 in the first pixel column and the second sub-pixel 12 in the fourth pixel column correspond to the two second sub-pixels 12 in the second pixel column respectively.

Two first sub-pixels 11 in the first pixel column of the second sub-pixel group 2 are arranged in sequence; two second sub-pixels 12 in the second pixel column of the second sub-pixel group 2 are arranged in sequence; the third pixel column in the second sub-pixel group 2 is provided with a third sub-pixel 13; and the fourth pixel column in the second sub-pixel group 2 is provided with a second sub-pixel 12. Both the third sub-pixel 13 in the third pixel column and the second sub-pixel 12 in the fourth pixel column correspond to the two second sub-pixels 12 in the second pixel column respectively.

The first pixel column in the third sub-pixel group 3 is provided with third sub-pixels 13; the second pixel column in the third sub-pixel group 3 is provided with a second sub-pixel 12; the third pixel column in the third sub-pixel group 3 is provided with a first sub-pixel 11; and two second sub-pixels 12 in the fourth pixel column of the third sub-pixel group 3 are arranged in sequence. Both the second sub-pixel 12 in the second pixel column and the first sub-pixel 11 in the third pixel column correspond to the two second sub-pixels 12 in the fourth pixel column, respectively.

The first pixel column in the fourth sub-pixel group 4 is provided with a third sub-pixel 13; the second pixel column in the fourth sub-pixel group 4 is provided with a second sub-pixel 12; two first sub-pixels 11 in the third pixel column of the fourth sub-pixel group 4 are arranged in sequence; and two second sub-pixels 12 in the fourth pixel column of the fourth sub-pixel group 4 are arranged in sequence. Both the third sub-pixel 13 in the first pixel column and the second sub-pixel 12 in the second pixel column correspond to the two first sub-pixels 11 in the third pixel column, respectively.

The first sub-pixel group 1 and the second sub-pixel group 2 are arranged side by side; the third sub-pixel group 3 and the fourth sub-pixel group 4 are arranged side by side; the pixel columns in the first sub-pixel group 1 correspond to the pixel columns in the third sub-pixel group 3; and the pixel columns in the second sub-pixel group 2 correspond to the pixel columns in the fourth sub-pixel group 4.

The first sub-pixel group 1 and the third sub-pixel group 3 are arranged upper and lower in the vertical direction; the first sub-pixel group 1 is disposed on the third pixel group 2; the first pixel column in the first sub-pixel group 1 corresponds to the first pixel column in the third sub-pixel group 3; the second pixel column in the first sub-pixel group 1 corresponds to the second pixel column in the third sub-pixel group 3; the third pixel column in the first sub-pixel group 1 corresponds to the third pixel column in the third sub-pixel group 3; and the fourth pixel column in the first sub-pixel group corresponds to the fourth pixel column in the third sub-pixel group 3.

The second sub-pixel group 2 and the fourth sub-pixel group 4 are arranged upper and lower in the vertical direction; the second sub-pixel group 2 is disposed on the fourth pixel group 4; the first pixel column in the second sub-pixel group 2 corresponds to the first pixel column in the fourth sub-pixel group 4; the second pixel column in the second sub-pixel group 2 corresponds to the second pixel column in the fourth sub-pixel group 4; the third pixel column in the second sub-pixel group 2 corresponds to the third pixel column in the fourth sub-pixel group 4; and the fourth pixel column in the second sub-pixel group corresponds to the fourth pixel column in the fourth sub-pixel group 4.

In the embodiment, the third pixel column in the first sub-pixel group 1 is provided with two third sub-pixels 13. The two third sub-pixels 13 are arranged in sequence. The first sub-pixel 11 in the first pixel column and the second sub-pixel 12 in the fourth pixel column of the first sub-pixel group 1 are arranged in a same pixel row as the third sub-pixel 13 in the third pixel column and the second sub-pixel 12 in the fourth pixel column of the second sub-pixel group 2. The first second sub-pixel 12 in the second pixel column and the first third sub-pixel 13 in the third pixel column of the first sub-pixel group 1 are arranged in a same pixel row as the first first sub-pixel 11 in the first pixel column and the first second sub-pixel 12 in the second pixel column of the second sub-pixel group 2. The second second sub-pixel 12 in the second pixel column and the second third sub-pixel 13 in the third pixel column of the first sub-pixel group 1 are arranged in a same pixel row as the second first sub-pixel 11 in the first pixel column and the second second sub-pixel 12 in the second pixel column of the second sub-pixel group 2.

In at least one embodiment, the midpointd of the connecting lines between the luminescent centers of both the first sub-pixel 11 in the first pixel column and the second sub-pixel 12 in the fourth pixel column of the first sub-pixel group 1 and the luminescent centers of the two second sub-pixels 12 in the second pixel column are both disposed on a same straight line in the row direction. In at least one embodiment, the midpoints of the connecting lines between the luminescent centers of both the third sub-pixel 13 in the third pixel column and the second sub-pixel 12 in the fourth pixel column of the second sub-pixel group 2 and the luminescent centers of the two second sub-pixels 12 in the second pixel column are both disposed on a same straight line in the row direction.

In the embodiment, the first pixel column in the third sub-pixel group 3 is provided with two third sub-pixels 13. The two third sub-pixels 13 are arranged in sequence. The second sub-pixel 12 in the second pixel column and the first sub-pixel 11 in the third pixel column of the third sub-pixel group 3 are arranged in a same pixel row as the third sub-pixel 13 in the first pixel column and the second sub-pixel 12 in the second pixel column of the fourth sub-pixel group 4. The first third sub-pixel 13 in the first pixel column and the first second sub-pixel 12 in the fourth pixel column of the third sub-pixel group 3 are arranged in a same pixel row as the first first sub-pixel 11 in the third pixel column and the first second sub-pixel 12 in the fourth pixel column of the fourth sub-pixel group 4. The second third sub-pixel 13 in the first pixel column and the second second sub-pixel 12 in the fourth pixel column of the third sub-pixel group 3 are arranged in a same pixel row as the second first sub-pixel 11 in the third pixel column and the second second sub-pixel 12 in the fourth pixel column of the fourth sub-pixel group 4.

In at least one embodiment, the midpoints of the connecting lines between luminescent centers of both the second sub-pixel 12 in the second pixel column and the first sub-pixel 11 in the third pixel column of the third sub-pixel group 3 and the luminescent centers of the two second sub-pixels 12 in the fourth pixel column are both disposed on the same straight line in the row direction. In at least one embodiment, the midpoints of the connecting lines between luminescent centers of both the third sub-pixel 13 in the first pixel column and the second sub-pixel 12 in the second pixel column of the fourth sub-pixel group 4 and the luminescent centers of the two first sub-pixels 11 in the third pixel column are both disposed on a same straight line in the row direction.

In at least one embodiment, the first sub-pixel 11 is a red sub-pixel R; the second sub-pixel 12 is a green sub-pixel G; the third sub-pixel 13 is a blue sub-pixel B; and hence the sub-pixels in the display substrate are arranged in RG/BG mode. In actual application, the first sub-pixel 11, the second sub-pixel 12 and the third sub-pixel 13 may also be sub-pixels of other colors. No further description will be given here.

Detailed description will be given below to the calculation method of output values of the sub-pixels in the display substrate provided by the embodiment with reference to one example. Description is given in the embodiment by taking the case that the first sub-pixel 11 is a red sub-pixel R, the second sub-pixel 12 is a green sub-pixel G, and the third sub-pixel 13 is a blue sub-pixel B, as an example.

Because each pixel group includes six first sub-pixels 11, twelve second sub-pixels 12 and six third sub-pixels 13, R:G:B=1:2:1. In the embodiment, the total number of input values of input signals for all the sub-pixels of the display substrate is $M\times N\times 3$, namely the input signals include $M\times N$ input values of first sub-pixels, $M\times N$ input values of second sub-pixels, and $M\times N$ input values of third sub-pixels, in which M refers to the row resolution and N refers to the column resolution. As the replace ratio (RR) of the display substrate in display is 1.5, the total number of output values of output signals for all the sub-pixels of the display substrate is $M\times N\times 3/2$, in which the RR being 1.5 refers to that 1.5 sub-pixels are adopted to replace one pixel. As R:G:B=1:2:1, in the display substrate, the number of the output values of the first sub-pixels 11 is $M\times N\times 3/2\times 1/4=M\times N\times 3/8=M\times N/4+M/2\times N/4$; the number of the output values of the second sub-pixels 12 is $M\times N\times 3/2\times 2/4=M\times N\times 3/4=M\times N/2+M\times N/4$; and the number of the output values of the third sub-pixels 13 is $M\times N\times 3/2\times 1/4=M\times N\times 3/8=M\times N/4+M/2\times N/4$.

As seen from above, the number of the output values of the first sub-pixels 11 is ⅜ of the number of the input values of the first sub-pixels; the number of the output values of the second sub-pixels 12 is ¾ of the number of the input values of the second sub-pixels; and the number of the output values of the third sub-pixels 13 is ⅜ of the number of the input values of the third sub-pixels. According to the above conclusion, in an embodiment, the following calculation method can be adopted to calculate the output values of the sub-pixels. It should be noted that in actual application, other calculation methods may also be adopted to calculate the output values of the sub-pixels. No further description will be given here.

The output value of the first sub-pixel 11 in the first pixel column of the first sub-pixel group 1 is obtained by dividing, by four, the sum of input values of four first sub-pixels corresponding to the first sub-pixel 11 in the first pixel column. If the input values of the four first sub-pixels corresponding to the output value R1_outij of the first sub-pixel 11 are respectively Rin(2i−1, 4j−3), Rin(2i−1, 4j−2), Rin(2i, 4j−3) and Rin(2i, 4j−2), R1_outij=(Rin(2i−1, 4j−3), Rin(2i−1, 4j−2), Rin(2i, 4j−3)+Rin(2i, 4j−2))/4, in which i is the line number and 1≤i≤M/2, and j is the column number and 1≤j≤N/4. The output value of the first sub-pixel 11 in the first pixel column is R1_out11=(Rin11+Rin12+Rin21+Rin22)/4. The output value of the first sub-pixel 11 in the first pixel column of the first sub-pixel group 1 in other pixel groups is analogical, and therefore no further description will be given here.

The output value of each second sub-pixel 12 in the second pixel column of the first sub-pixel group 1 is an input value of a second sub-pixel corresponding to each second sub-pixel 12 in the second pixel column. If the input value of the second sub-pixel corresponding to the output value G2_outij of the second sub-pixel 12 is Gin(i, 2j), G2_outij=Gin(i, 2j), in which i is the row number and 1≤i≤M, and j is the column number and 1≤j≤N/2. The output value of the first second sub-pixel 12 in the second pixel column is G2_out11=Gin12, and the output value of the second second sub-pixel 12 in the second pixel column is G2_out21=Gin22. The output value of the second sub-pixel 12 in the second pixel column of the first sub-pixel group 1 in other pixel groups is analogical, and therefore no further description will be given here.

The output value of the third sub-pixel 13 in the third pixel column of the first sub-pixel group 1 is obtained by dividing, by two, the sum of input values of two third sub-pixels corresponding to the third sub-pixel 13 in the third pixel column. If the input values of the two third sub-pixels corresponding to the output value B1_outij of the third sub-pixel 13 are respectively Bin(i, 4j−1) and Bin(i, 4j), B1_outij=(Bin(i, 4j−1)+Bin(i, 4j))/2, in which i is the row number and 1≤i≤M, and j is the column number and 1≤j≤N/4. The output value of the first third sub-pixel 13 in the third pixel column is B1_out11=(Bin13+Bin14)/2, and the output value of the second third sub-pixel 13 in the third pixel column is B1_out21=(Bin23+Bin24)/2. The output value of the third sub-pixel 13 in the third pixel column of the first sub-pixel group 1 in other pixel groups is analogical, and therefore no further description will be given here.

The output value of the second sub-pixel 12 in the fourth pixel column of the first sub-pixel group 1 is obtained by dividing, by two, the sum of input values of two second sub-pixels corresponding to the second sub-pixel 12 in the fourth pixel column. If the input values of the two second sub-pixels corresponding to the second sub-pixel 12 are respectively Gin(2i−1, 2j−1) and Gin(2i, 2j−1), G1_outij=(Gin(2i−1, 2j−1)+Gin(2i, 2j−1))/2, in which i is the row number and 1≤i≤M; j is the column number and 1≤j≤N/2; and i is an odd number. The output value of the second sub-pixel 12 in the fourth pixel column is G1_out11=(Gin11+Gin21)/2. The output value of the second sub-pixel 12 in the fourth pixel column of the first sub-pixel group 1 in other pixel groups is analogical, and therefore no further description will be given here.

The output value of each first sub-pixel 11 in the first pixel column of the second sub-pixel group 2 is obtained by dividing, by two, the sum of input values of two first sub-pixels corresponding to each first sub-pixel in the first pixel column. If the input values of the two first sub-pixels corresponding to the output value R2_outij of the first sub-pixel 11 are respectively Rin(i, 4j−1) and Rin(i, 4j), R2_outij=(Rin(i, 4j−1)+Rin(i, 4j))/2, in which i is the row number and 1≤i≤M, and j is the column number and 1≤j≤N/4. The output value of the first first sub-pixel 11 in the first pixel column is R2_out11=(Rin13+Rin14)/2, and the output value of the second first sub-pixel 11 in the first pixel column is R2_out21=(Rin23+Rin24)/2. The output value of the first sub-pixel 11 in the first pixel column of the second sub-pixel group 2 in other pixel groups is analogical, and therefore no further description will be given here.

The output value of each second sub-pixel 12 in the second pixel column of the second sub-pixel group 2 is an input value of a second sub-pixel corresponding to each second sub-pixel 12 in the second pixel column. The calculation method of the output value of each second sub-pixel 12 in the second pixel column of the second sub-pixel group 2 is the same as the calculation method of the output value of each second sub-pixel 12 in the second pixel column of the first sub-pixel group 1. For instance, the calculation methods of G2_out12 and G2_out22 are the same as the calculation methods of G2_out11 and G2_out21, and therefore no further description will be given here.

The output value of the third sub-pixel 13 in the third pixel column of the second sub-pixel group 2 is obtained by dividing, by four, the sum of input values of four third sub-pixels corresponding to the third sub-pixel 13 in the third pixel column. If the input values of the four first sub-pixels corresponding to the output value B2_outij of the third sub-pixel 13 are respectively Bin(2i−1, 4j−3), Bin(2i−1, 4j−2), Bin(2i, 4j−3) and Bin(2i, 4j−2), B2_outij=(Bin(2i−1, 4j−3), Bin(2i−1, 4j−2), Bin(2i, 4j−3)+Bin(2i, 4j−2))/4, in which i is the row number and 1≤i≤M/2, and j is the column number and 1≤j≤N/4. The output value of the third sub-pixel 13 in the third pixel column is B2_out11=(Bin11+Bin12+Bin21+Bin22)/4. The output value of the third sub-pixel 13 in the third pixel column of the second sub-pixel group 2 in other pixel groups is analogical, and therefore no further description will be given here.

The output value of the second sub-pixel 12 in the fourth pixel column of the second sub-pixel group 2 is an input value of a second sub-pixel corresponding to the second sub-pixel 12 in the fourth pixel column. The calculation method of the output value of the second sub-pixel 12 in the fourth pixel column of the second sub-pixel group 2 is the same as the calculation method of the output value of the second sub-pixel 12 in the fourth pixel column of the first sub-pixel group 1. For instance, the calculation method of G1_out12 is the same as that of G1_out11. No further description will be given here.

The output value of the third sub-pixel 13 in the first pixel column of the third sub-pixel group 3 is obtained by dividing, by two, the sum of input values of two third sub-pixels corresponding to the third sub-pixel 13 in the first pixel column. If the input values of the two third sub-pixels corresponding to the output value B1_outij of the third sub-pixel 13 are respectively Bin(i, 4j−1) and Bin(i, 4j), B1_outij=(Bin(i, 4j−1)+Bin(i, 4j))/2, in which i is the row number and 1≤i≤M, and j is the column number and 1≤j≤N/4. The output value of the first third sub-pixel 13 in the first pixel column is B1_out31=(Bin33+Bin34)/2, and the output value of the second third sub-pixel 13 in the first pixel column is B1_out41=(Bin43+Bin44)/2. The output value of the third sub-pixel 13 in the first pixel column of the third sub-pixel group 3 in other pixel groups is analogical, and therefore no further description will be given here.

The output value of the second sub-pixel 12 in the second pixel column of the third sub-pixel group 3 is obtained by dividing, by two, the sum of input values of two second sub-pixels corresponding to the second sub-pixel 12 in the second pixel column. If the input values of the two second sub-pixels corresponding to the second sub-pixel 12 are respectively Gin(2i−1, 2j) and Gin(2i, 2j), G1_outij=(Gin(2i−1, 2j)+Gin(2i, 2j))/2, wherein i is the row number and 1≤i≤M; j is the column number and 1≤j≤N/2; and i is an even number. The output value of the second sub-pixel 12 in the second pixel column is G1_out21=(Gin32+Gin42)/2. The output value of the second sub-pixel 12 in the second pixel column of the second sub-pixel group 2 in other pixel groups is analogical, and therefore no further description will be given here.

The output value of the first sub-pixel 11 in the third pixel column of the third sub-pixel group 3 is obtained by dividing, by four, the sum of input values of four first sub-pixels corresponding to the first sub-pixel 11 in the third pixel column The calculation method of the output value of the first sub-pixel 11 in the third pixel column of the third sub-pixel group 3 is the same as the calculation method of the output value of the first sub-pixel 11 in the first pixel column of the first sub-pixel group 1. For instance, the calculation method of R1_out21 is the same as that of R1_out11. No further description will be given here.

The output value of each second sub-pixel 12 in the fourth pixel column of the third sub-pixel group 3 is an input value of a second sub-pixel corresponding to each second sub-pixel 12 in the fourth pixel column. The calculation method of the output value of each second sub-pixel 12 in the fourth pixel column of the third sub-pixel group 3 is the same as the calculation method of the output value of each second sub-pixel 12 in the second pixel column of the first sub-pixel group 1. For instance, the calculation methods of G2_out31 and G2_out41 are the same as the calculation methods of G2_out11 and G2_out21. No further description will be given here.

The output value of the third sub-pixel 13 in the first pixel column of the fourth sub-pixel group 4 is obtained by dividing, by four, the sum of input values of four third sub-pixels corresponding to the third sub-pixel 13 in the first pixel column. The calculation method of the output value of the third sub-pixel 13 in the first pixel column of the fourth sub-pixel group 4 is the same as the calculation method of the output value of the third sub-pixel 13 in the third pixel column of the second sub-pixel group 2. For instance, the calculation method of B2_out21 is the same as that of B2_out11. No further description will be given here.

The output value of the second sub-pixel 12 in the second pixel column of the fourth sub-pixel group 4 is obtained by dividing, by two, the sum of input values of two second sub-pixels corresponding to the second sub-pixel in the second pixel column. The calculation method of the output value of the second sub-pixel 12 in the second pixel column of the fourth sub-pixel group 4 is the same as the calculation method of the output value of the second sub-pixel 12 in the second pixel column of the third sub-pixel group 3. For instance, the calculation method of G1_out22 is the same as that of G1_out21. No further description will be given here.

The output value of each first sub-pixel 11 in the third pixel column of the fourth sub-pixel group 4 is obtained by dividing, by two, the sum of input values of two first sub-pixels corresponding to each first sub-pixel in the third pixel column. The calculation method of the output value of each first sub-pixel 11 in the third pixel column of the fourth sub-pixel group 4 is the same as the calculation method of the output value of the first sub-pixel 11 in the first pixel column of the second sub-pixel group 2. For instance, the calculation methods of R2_out31 and R2_out41 are the same as the calculation methods of R2_out11 and R2_out21. No further description will be given here.

The output value of each second sub-pixel 12 in the fourth pixel column of the fourth sub-pixel group 4 is an input value of a second sub-pixel corresponding to each second sub-pixel 12 in the fourth pixel column. The calculation method of the output value of each second sub-pixel 12 in the fourth pixel column of the fourth sub-pixel group 4 is the same as the calculation method of the output value of each second sub-pixel 12 in the second pixel column of the first sub-pixel group 1. For instance, the calculation methods of G2_out32 and G2_out42 are the same as the calculation methods of G2_out11 and G2_out21. No further description will be given here.

The display substrate provided by the embodiment adopts the RG/BG pixel arrangement mode. Compared with the RG/BG pixel arrangement mode in the state of art, the number of the first sub-pixels, the second sub-pixels and the third sub-pixels is reduced, and hence the RG/BG pixel arrangement mode is formed on the basis of reducing the number of the first sub-pixels, the second sub-pixels and the third sub-pixels.

In actual application, the display substrate provided by the embodiment is subjected to image simulation display test and black-white line display test, and the result indicates that the display substrate provided by the embodiment obtains a high resolution. Therefore, although the number of the first sub-pixels, the second sub-pixels and the third sub-pixels is reduced in the embodiment, high resolution can be obtained by adoption of an appropriate calculation method. As the number of the first sub-pixels, the second sub-pixels and the third sub-pixels is reduced simultaneously in the embodiment, the display substrate provided by the embodiment is particularly applicable to display devices with ultra-high resolution. When the display substrate is applied to display devices with ultra-high resolution, the influence caused by the reduced number of the sub-pixels can be reduced.

In the technical proposal of the display substrate provided by the embodiment, each pixel group includes four sub-pixel groups and includes six first sub-pixels, twelve second sub-pixels, and six third sub-pixels. In the embodiment, the number of the first sub-pixels, the second sub-pixels, and the third sub-pixels in each pixel group is reduced, so that the number of the sub-pixels in the whole display device can be reduced, and hence the difficulty in the manufacturing process of the display device and the cost can be reduced on the premise of ensuring that the display device obtains a high resolution.

Figure 2:
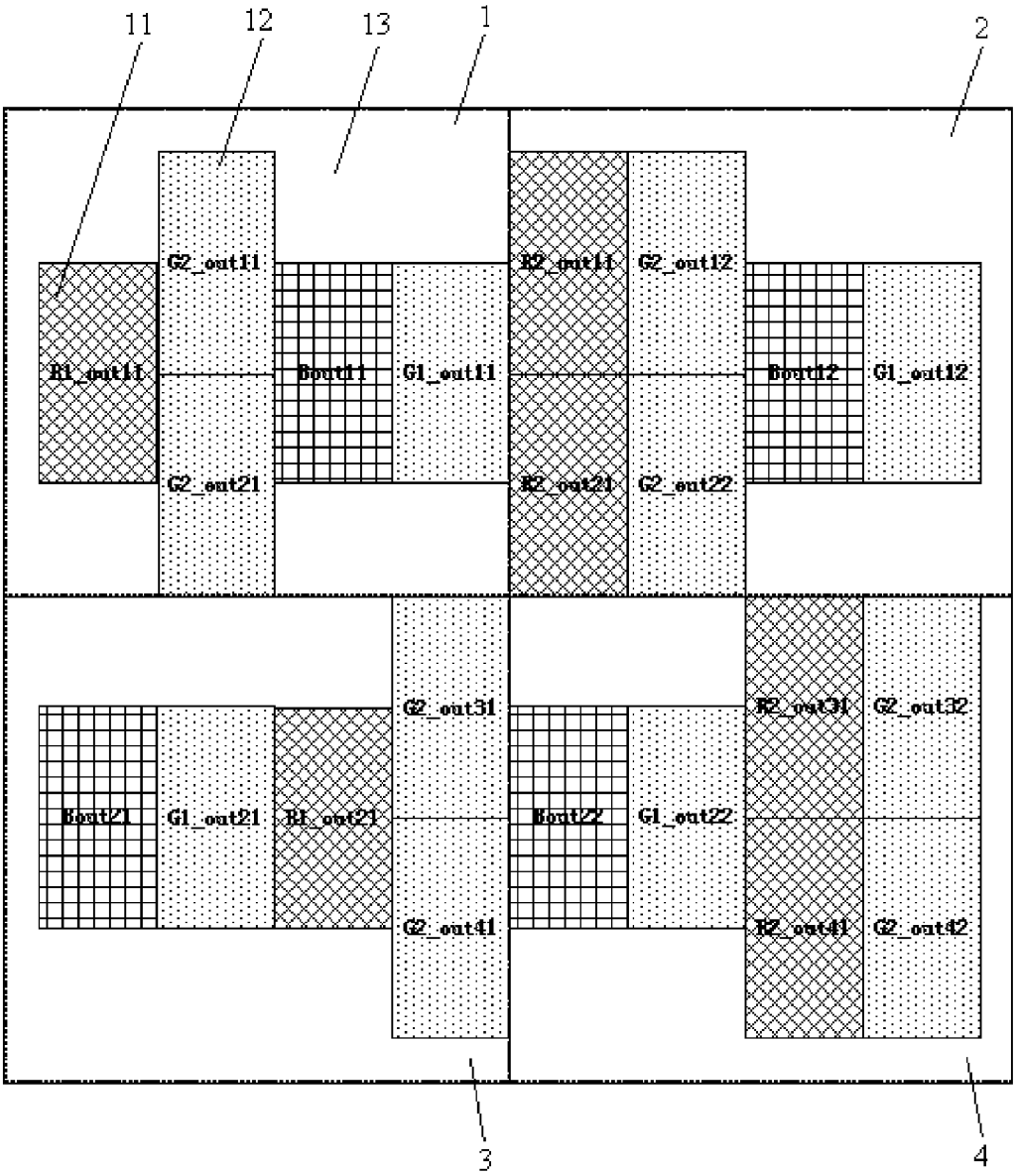
FIG. 2 is a schematic partial structural view of a display substrate provided by a second embodiment of the present disclosure.

FIG. 2 is a schematic partial structural view of a display substrate provided by a second embodiment of the present disclosure. As illustrated in FIG. 2, the display substrate comprises repeatedly arranged pixel groups; each pixel group includes a first sub-pixel group 1, a second sub-pixel group 2, a third sub-pixel group 3, and a fourth sub-pixel group 4; and each of the first sub-pixel group 1, the second sub-pixel group 2, the third sub-pixel group 3, and the fourth sub-pixel group 4 includes four pixel columns.

The first pixel column of the first sub-pixel group 1 is provided with a first sub-pixel 11; two second sub-pixels 12 in the second pixel column of the first sub-pixel group 1 are arranged in sequence; the third pixel column in the first sub-pixel group 1 is provided with a third sub-pixel 13; and the fourth pixel column in the first sub-pixel group 1 is provided with a second sub-pixel 12. Both the first sub-pixel 11 in the first pixel column and the second sub-pixel 12 in the fourth pixel column correspond to the two second sub-pixels 12 in the second pixel column.

Two first sub-pixels 11 in the first pixel column of the second sub-pixel group 2 are arranged in sequence; two second sub-pixels 12 in the second pixel column of the second sub-pixel group 2 are arranged in sequence; the third pixel column in the second sub-pixel group 2 is provided with a third sub-pixel 13; and the fourth pixel column in the second sub-pixel group 2 is provided with a second sub-pixel 12. Both the third sub-pixel 13 in the third pixel column and the second sub-pixel 12 in the fourth pixel column correspond to the two second sub-pixels 12 in the second pixel column.

The first pixel column in the third sub-pixel group is provided with a third sub-pixel 13; the second pixel column in the third sub-pixel group 3 is provided with a second sub-pixel 12; the third pixel column in the third sub-pixel group 3 is provided with a first sub-pixel 11; and two second sub-pixels 12 in the fourth pixel column of the third sub-pixel group 3 are arranged in sequence. Both the second sub-pixel 12 in the second pixel column and the first sub-pixel 11 in the third pixel column correspond to the two second sub-pixels 12 in the third pixel column.

The first pixel column in the fourth sub-pixel group 4 is provided with a third sub-pixel 13; the second pixel column in the fourth sub-pixel group 4 is provided with a second sub-pixel 12; two first sub-pixels 11 in the third pixel column of the fourth sub-pixel group 4 are arranged in sequence; and two second sub-pixels 12 in the fourth pixel column of the fourth sub-pixel group 4 are arranged in sequence. Both the third sub-pixel 13 in the first pixel column and the second sub-pixel 12 in the second pixel column correspond to the two first sub-pixels 11 in the third pixel column.

The first sub-pixel group 1 and the second sub-pixel group 2 are arranged side by side; the third sub-pixel group 3 and the fourth sub-pixel group 4 are arranged side by side; the pixel columns in the first sub-pixel group 1 correspond to the pixel columns in the third sub-pixel group 3; and the pixel columns in the second sub-pixel group 2 correspond to the pixel columns in the fourth sub-pixel group 4.

The first sub-pixel group 1 and the third sub-pixel group 3 are arranged upper and lower in the vertical direction; the first sub-pixel group 1 is disposed on the third pixel group 2; the first pixel column in the first sub-pixel group 1 corresponds to the first pixel column in the third sub-pixel group 3; the second pixel column in the first sub-pixel group 1 corresponds to the second pixel column in the third sub-pixel group 3; the third pixel column in the first sub-pixel group 1 corresponds to the third pixel column in the third sub-pixel group 3; and the fourth pixel column in the first sub-pixel group corresponds to the fourth pixel column in the third sub-pixel group 3.

The second sub-pixel group 2 and the fourth sub-pixel group 4 are arranged upper and lower in the vertical direction; the second sub-pixel group 2 is disposed on the fourth pixel group 4; the first pixel column in the second sub-pixel group 2 corresponds to the first pixel column in the fourth sub-pixel group 4; the second pixel column in the second sub-pixel group 2 corresponds to the second pixel column in the fourth sub-pixel group 4; the third pixel column in the second sub-pixel group 2 corresponds to the third pixel column in the fourth sub-pixel group 4; and the fourth pixel column in the second sub-pixel group corresponds to the fourth pixel column in the fourth sub-pixel group 4.

In the embodiment, the third pixel column in the first sub-pixel group 1 is provided with a third sub-pixel 13. The third sub-pixel 13 in the third pixel column of the first sub-pixel group 1 corresponds to the two second sub-pixels 12 in the second pixel column. The first sub-pixel 11 in the first pixel column, the third sub-pixel 13 in the third pixel column, and the second sub-pixel 12 in the fourth pixel column of the first sub-pixel group 1 are arranged in a same pixel row as the third sub-pixel 13 in the third pixel column and the second sub-pixel 12 in the fourth pixel column of the second sub-pixel group 2. The first second sub-pixel 12 in the second pixel column of the first sub-pixel group 1 is arranged in a same pixel row as the first first sub-pixel 11 in the first pixel column and the first second sub-pixel 12 in the second pixel column of the second sub-pixel group 2. The second second sub-pixel 12 in the second pixel column of the first sub-pixel group 1 is arranged in a same pixel row as the second first sub-pixel 11 in the first pixel column and the second second sub-pixel 12 in the second pixel column of the second sub-pixel group 2.

In at least one embodiment, the midpoints of the connecting lines between the luminescent centers of the first sub-pixel 11 in the first pixel column, the third sub-pixel 13 in the third pixel column, and the second sub-pixel 12 in the fourth pixel column of the first sub-pixel group 1 and the luminescent centers of the two second sub-pixels 12 in the second pixel column are all disposed on the same straight line in the row direction. In at least one embodiment, the midpoints of the connecting lines between the luminescent centers of the third sub-pixel 13 in the third pixel column and the second sub-pixel 12 in the fourth pixel column of the second sub-pixel group 2 and the luminescent centers of the two second sub-pixels 12 in the second pixel column are all disposed on the same straight line in the row direction.

In the embodiment, the first pixel column in the third sub-pixel group 3 is provided with a third sub-pixel 13. The first sub-pixel 11 in the third pixel column of the third sub-pixel group 3 corresponds to the second sub-pixel 12 in the second pixel column. The third sub-pixel 13 in the first pixel column, the second sub-pixel 12 in the second pixel column, and the first sub-pixel 11 in the third pixel column of the third sub-pixel group 3 are arranged in a same pixel row as the third sub-pixel 13 in the first pixel column and the second sub-pixel 12 in the second pixel column of the fourth sub-pixel group 4. The first second sub-pixel 12 in the fourth pixel column of the third sub-pixel group 3 is arranged in a same pixel row as the first first sub-pixel 11 in the third pixel column and the first second sub-pixel 12 in the fourth pixel column of the fourth sub-pixel group 4. The second second sub-pixel 12 in the fourth pixel column of the third sub-pixel group 3 is arranged in a same pixel row as the second first sub-pixel 11 in the third pixel column and the second second sub-pixel 12 in the fourth pixel column of the fourth sub-pixel group 4.

In at least one embodiment, the midpoints of the connecting lines between the luminescent centers of the third sub-pixel 13 in the first pixel column, the second sub-pixel 12 in the second pixel column, and the first sub-pixel 11 in the third pixel column of the third sub-pixel group 3 and the luminescent centers of the two second sub-pixels 12 in the fourth pixel column are all disposed on the same straight line in the row direction. In at least one embodiment, the midpoints of the connecting lines between the luminescent centers of the third sub-pixel 13 in the first pixel column and the second sub-pixel 12 in the second pixel column of the fourth sub-pixel group 4 and the luminescent centers of the two first sub-pixels 11 in the third pixel column are all disposed on the same straight line in the row direction.

In at least one embodiment, the first sub-pixel 11 is a red sub-pixel R; the second sub-pixel 12 is a green sub-pixel G; the third sub-pixel 13 is a blue sub-pixel B; and hence the sub-pixels in the display substrate are arranged in RG/BG mode. In actual application, the first sub-pixel 11, the second sub-pixel 12 and the third sub-pixel 13 may also be sub-pixels of other colors. No further description will be given here.

Detailed description will be given below to the calculation method of output values of the sub-pixels in the display substrate provided by the embodiment with reference to a specific example. Description is given in the embodiment by taking the case that the first sub-pixel 11 is a red sub-pixel R, the second sub-pixel 12 being a green sub-pixel G, the third sub-pixel 13 being a blue sub-pixel B, as an example.

As each pixel group includes six first sub-pixels 11, twelve second sub-pixels 12 and four third sub-pixels 13, R:G:B=3:6:2. In the embodiment, the total number of input values of input signals of all the sub-pixels of the display substrate is M×N×3, namely the input signals include M×N input values of first sub-pixels, M×N input values of second sub-pixels, and M×N input values of third sub-pixels, in which M refers to the row resolution and N refers to the column resolution. As the RR of the display substrate in display is 1.5, the total number of output values of output signals of all the sub-pixels of the display substrate is M×N×3/2, in which the RR being 1.5 refers to that 1.5 sub-pixels are adopted to replace one pixel. As R:G:B=3:6:2, in the display substrate, the number of the output values of the first sub-pixels 11 is M×N×3/2×3/11=M×N×9/22; the number of the output values of the second sub-pixels 12 is M×N×3/2×6/11=M×N×9/11; and the number of the output values of the third sub-pixels 13 is M×N×3/2×2/11=M×N×3/11.

As seen from above, the number of the output values of the first sub-pixels 11 is 9/22 of the number of the input values of the first sub-pixels; the number of the output values of the second sub-pixels 12 is 9/11 of the number of the input values of the second sub-pixels; and the number of the output values of the third sub-pixels 13 is 3/11 of the number of the input values of the third sub-pixels. According to the above conclusion, in an embodiment, the following calculation method can be adopted to calculate the output values of the sub-pixels. It should be noted that: in actual application, other calculation methods may also be adopted to calculate the output values of the sub-pixels. No further description will be given here.

The output value of the first sub-pixel 11 in the first pixel column of the first sub-pixel group 1 is obtained by dividing, by four, the sum of input values of four first sub-pixels corresponding to the first sub-pixel 11 in the first pixel column. If the input values of the four first sub-pixels corresponding to the output value R1_outij of the first sub-pixel 11 are respectively Rin(2i−1, 4j−3), Rin(2i−1, 4j−2), Rin(2i, 4j−3) and Rin(2i, 4j−2), R1_outij=(Rin(2i−1, 4j−3), Rin(2i−1, 4j−2), Rin(2i, 4j−3)+Rin(2i, 4j−2))/4, in which i is the line number and 1≤i≤M/2, and j is the column number and 1≤j≤N/4. The output value of the first sub-pixel 11 in the first pixel column is R1_out11=(Rin11+Rin12+Rin21+Rin22)/4. The output value of the first sub-pixel 11 in the first pixel column of the first sub-pixel group 1 in other pixel groups is analogical, and therefore no further description will be given here.

The output value of each second sub-pixel 12 in the second pixel column of the first sub-pixel group 1 is an input value of a second sub-pixel corresponding to each second sub-pixel 12 in the second pixel column. If the input value of the second sub-pixel corresponding to the output value G2_outij of the second sub-pixel 12 is Gin(i, 2j), G2_outij=Gin(i, 2j), in which i is the row number and 1≤i≤M, and j is the column number and 1≤j≤N/2. The output value of the first second sub-pixel 12 in the second pixel column is G2_out11=Gin12, and the output value of the second second sub-pixel 12 in the second pixel column is G2_out21=Gin22. The output value of the second sub-pixel 12 in the second pixel column of the first sub-pixel group 1 in other pixel groups is analogical, and therefore no further description will be given here.

The output value of the third sub-pixel 13 in the third pixel column of the first sub-pixel group 1 is obtained by dividing, by four, the sum of input values of four third sub-pixels corresponding to the third sub-pixel 13 in the third pixel column. If the input values of the four third sub-pixels corresponding to the output value Boutij of the third sub-pixel 13 are respectively Bin(2i−1, 2j−1), Bin(2i−1, 2j), Bin(2i, 2j−1) and Bin(2i, 2j), B2_outij=(Bin(2i−1, 2j−1), Bin(2i−1, 2j), Bin(2i, 2j−1)+Bin(2i, 2j))/4, in which i is the row number and 1≤i≤M, and j is the column number and 1≤j≤N/2. The output value of the third sub-pixel 13 in the third pixel column is Bout11=(Bin11, Bin12, Bin21+Bin11)/4. The output value of the third sub-pixel 13 in the third pixel column of the first sub-pixel group 1 in other pixel groups is analogical, and therefore no further description will be given here.

The output value of the second sub-pixel 12 in the fourth pixel column of the first sub-pixel group 1 is obtained by dividing, by two, the sum of input values of two second sub-pixels corresponding to the second sub-pixel 12 in the fourth pixel column. If the input values of the two second sub-pixels corresponding to the second sub-pixel 12 are respectively Gin(2i−1, 2j−1) and Gin(2i, 2j−1), G1_outij=(Gin(2i−1, 2j−1)+Gin(2i, 2j−1))/2, in which i is the row number and 1≤i≤M; j is the column number and 1≤j≤N/2; and i is an odd number. The output value of the second sub-pixel 12 in the fourth pixel column is G1_out11=(Gin11+Gin21)/2. The output value of the second sub-pixel 12 in the fourth pixel column of the first sub-pixel group 1 in other pixel groups is analogical, and therefore no further description will be given here.

The output value of each first sub-pixel 11 in the first pixel column of the second sub-pixel group 2 is obtained by dividing, by two, the sum of input values of two first sub-pixels corresponding to each first sub-pixel in the first pixel column. If the input values of the two first sub-pixels corresponding to the output value R2_outij of the first sub-pixel 11 are respectively Rin(i, 4j−1) and Rin(i, 4j), R2_outij=(Rin(i, 4j−1)+Rin(i, 4j))/2, in which i is the row number and 1≤i≤M, and j is the column number and 1≤j≤N/4. The output value of the first first sub-pixel 11 in the first pixel column is R2_out11=(Rin13+Rin14)/2, and the output value of the second first sub-pixel 11 in the first pixel column is R2_out21=(Rin23+Rin24)/2. The output value of the first sub-pixel 11 in the first pixel column of the second sub-pixel group 2 in other pixel groups is analogical, and therefore no further description will be given here.

The output value of each second sub-pixel 12 in the second pixel column of the second sub-pixel group 2 is an input value of a second sub-pixel corresponding to each second sub-pixel 12 in the second pixel column. The calculation method of the output value of each second sub-pixel 12 in the second pixel column of the second sub-pixel group 2 is the same as the calculation method of the output value of each second sub-pixel 12 in the second pixel column of the first sub-pixel group 1. For instance, the calculation methods of G2_out12 and G2_out22 are the same as the calculation methods of G2_out11 and G2_out21. No further description will be given here.

The output value of the third sub-pixel 13 in the third pixel column of the second sub-pixel group 2 is obtained by dividing, by four, the sum of input values of four third sub-pixels corresponding to the third sub-pixel 13 in the third pixel column. The calculation method of the output value of the third sub-pixel 13 in the third pixel column of the second sub-pixel group 2 is the same as the calculation method of the output value of the third sub-pixel 13 in the third pixel column of the first sub-pixel group 1. For instance, the calculation method of Bout12 is the same as that of Bout11. No further description will be given here.

The output value of the second sub-pixel 12 in the fourth pixel column of the second sub-pixel group 2 is an input value of a second sub-pixel corresponding to the second sub-pixel 12 in the fourth pixel column. The calculation method of the output value of the second sub-pixel 12 in the fourth pixel column of the second sub-pixel group 2 is the same as the calculation method of the output value of the second sub-pixel 12 in the fourth pixel column of the first sub-pixel group 1. For instance, the calculation method of G1_out12 is the same as that of G1_out11. No further description will be given here.

The output value of the third sub-pixel 13 in the first pixel column of the third sub-pixel group 3 is obtained by dividing, by four, the sum of input values of four third sub-pixels corresponding to the third sub-pixel 13 in the first pixel column. The calculation method of the output value of the third sub-pixel 13 in the first pixel column of the third sub-pixel group 3 is the same as the calculation method of the output value of the third sub-pixel 13 in the third pixel column of the first sub-pixel group 1. Specifically, the calculation method of Bout21 is the same as that of Bout11. No further description will be given here.

The output value of the second sub-pixel 12 in the second pixel column of the third sub-pixel group 3 is obtained by dividing, by two, the sum of input values of two second sub-pixels corresponding to the second sub-pixel 12 in the second pixel column. If the input values of the two second sub-pixels corresponding to the second sub-pixel 12 are respectively Gin(2i−1, 2j) and Gin(2i, 2j), G1_outij=(Gin(2i−1, 2j)+Gin(2i, 2j))/2, wherein i is the row number and $1 \leq i \leq M$; j is the column number and $1 \leq j \leq N/2$; and i is an even number. The output value of the second sub-pixel 12 in the second pixel column is G1_out21=(Gin32+Gin42)/2. The output value of the second sub-pixel 12 in the second pixel column of the third sub-pixel group 3 in other pixel groups is analogical, and therefore no further description will be given here.

The output value of the first sub-pixel 11 in the third pixel column of the third sub-pixel group 3 is obtained by dividing, by four, the sum of input values of four first sub-pixels corresponding to the first sub-pixel 11 in the third pixel column. The calculation method of the output value of the first sub-pixel 11 in the third pixel column of the third sub-pixel group 3 is the same as the calculation method of the output value of the first sub-pixel 11 in the first pixel column of the first sub-pixel group 1. For instance, the calculation method of R1_out21 is the same as that of R1_out11. No further description will be given here.

The output value of each second sub-pixel 12 in the fourth pixel column of the third sub-pixel group 3 is an input value of a second sub-pixel corresponding to each second sub-pixel 12 in the fourth pixel column. The calculation method of the output value of each second sub-pixel 12 in the fourth pixel column of the third sub-pixel group 3 is the same as the calculation method of the output value of each second sub-pixel 12 in the second pixel column of the first sub-pixel group 1. For instance, the calculation methods of G2_out31 and G2_out41 are the same as the calculation methods of G2_out11 and G2_out21. No further description will be given here.

The output value of the third sub-pixel 13 in the first pixel column of the fourth sub-pixel group 4 is obtained by dividing, by four, the sum of input values of four third sub-pixels corresponding to the third sub-pixel 13 in the first pixel column. The calculation method of the output value of the third sub-pixel 13 in the first pixel column of the fourth sub-pixel group 4 is the same as the calculation method of the output value of the third sub-pixel 13 in the third pixel column of the first sub-pixel group 1. For instance, the calculation method of Bout22 is the same as Bout11. No further description will be given here.

The output value of the second sub-pixel 12 in the second pixel column of the fourth sub-pixel group 4 is obtained by dividing, by two, the sum of input values of two second sub-pixels corresponding to the second sub-pixel in the second pixel column. The calculation method of the output value of the second sub-pixel 12 in the second pixel column of the fourth sub-pixel group 4 is the same as the calculation method of the output value of the second sub-pixel 12 in the second pixel column of the third sub-pixel group 3. For instance, the calculation method of G1_out22 is the same as that of G1_out21. No further description will be given here.

The output value of each first sub-pixel 11 in the third pixel column of the fourth sub-pixel group 4 is obtained by dividing, by two, the sum of input values of two first sub-pixels corresponding to each first sub-pixel in the third pixel column. The calculation method of the output value of each first sub-pixel 11 in the third pixel column of the fourth sub-pixel group 4 is the same as the calculation method of the output value of the first sub-pixel 11 in the first pixel column of the second sub-pixel group 2. For instance, the calculation methods of R2_out31 and R2_out41 are the same as the calculation methods of R2_out11 and R2_out21. No further description will be given here.

The output value of each second sub-pixel 12 in the fourth pixel column of the fourth sub-pixel group 4 is an input value of a second sub-pixel corresponding to each second sub-pixel 12 in the fourth pixel column. The calculation method of the output value of each second sub-pixel 12 in the fourth pixel column of the fourth sub-pixel group 4 is the same as the calculation method of the output value of each second sub-pixel 12 in the second pixel column of the first sub-pixel group 1. For instance, the calculation methods of G2_out32 and G2_out42 are the same as the calculation methods of G2_out11 and G2_out21. No further description will be given here.

The display substrate provided by the embodiment adopts the RG/BG pixel arrangement mode. Compared with the RG/BG pixel arrangement mode in the state of art, the number of the first sub-pixels, the second sub-pixels and the third sub-pixels is reduced, and hence the RG/BG pixel arrangement mode is formed on the basis of reducing the number of the first sub-pixels, the second sub-pixels and the third sub-pixels.

In actual application, the display substrate provided by the embodiment is subjected to image simulation display test and black-white line display test, and the result indicates that the display substrate provided by the embodiment obtains a high resolution. Therefore, although the number of the first sub-pixels, the second sub-pixels and the third sub-pixels is reduced in the embodiment, high resolution can be obtained by adoption of an appropriate calculation method. As the number of the first sub-pixels, the second sub-pixels and the third sub-pixels is reduced simultaneously in the embodiment, the display substrate provided by the embodiment is particularly applicable to display devices with an ultra-high resolution. When the display substrate is applied to display devices with an ultra-high resolution, the influence caused by the reduced number of the sub-pixels can be reduced.

In the technical proposal of the display substrate provided by the embodiment, each pixel group includes four sub-pixel groups and includes six first sub-pixels, twelve second sub-pixels, and four third sub-pixels. In the embodiment, the number of the first sub-pixels, the second sub-pixels and the third sub-pixels in each pixel group is reduced, so that the number of the sub-pixels in the whole display device can be reduced, and hence the difficulty in the manufacturing process of the display device and the cost can be reduced on the premise of ensuring that the display device obtains a high resolution.

The third embodiment of the present disclosure provides a display device, which comprises a display substrate. The display substrate may adopt the display substrate provided by the first embodiment or the second embodiment. No further description will be given here.

In the embodiment, the display device may comprise a liquid crystal display (LCD) device or an organic light-emitting diode (OLED) display device.

In the technical proposal of the display substrate provided by the embodiment, each pixel group includes four sub-pixel groups and includes six first sub-pixels, twelve second sub-pixels, and four third sub-pixels. In the embodiment, the number of the first sub-pixels, the second sub-pixels and the third sub-pixels in each pixel group is reduced, so that the number of the sub-pixels in the whole display device can be reduced, and hence the difficulty in the manufacturing process of the display device and the cost can be reduced on the premise of ensuring that the display device obtains a high resolution.

The fourth embodiment of the present disclosure provides a method for driving a display substrate. The method is used for driving the display substrate provided by the first embodiment. The method comprises the following steps.

S101: generating an output value of a first sub-pixel in the first pixel column, output values of two second sub-pixels in the second pixel column, output values of third sub-pixels in the third pixel column and an output value of a second sub-pixel in the fourth pixel column of the first sub-pixel group.

In the embodiment, the step S101, for instance, includes the following steps S1011 to S1014.

S1011: generating the output value of the first sub-pixel in the first pixel column according to input values of four first sub-pixels corresponding to the first sub-pixel in the first pixel column of the first sub-pixel group.

For instance, the output value of the first sub-pixel in the first pixel column is generated by dividing, by four, the sum of the input values of the four first sub-pixels corresponding to the first sub-pixel in the first pixel column of the first sub-pixel group.

S1012: generating the output value of each second sub-pixel in the second pixel column according to an input value of a second sub-pixel corresponding to each second sub-pixel in the second pixel column of the first sub-pixel group.

For instance, the input value of the second sub-pixel corresponding to each second sub-pixel in the second pixel column of the first sub-pixel group is set to be the output value of each second sub-pixel in the second pixel column.

S1013: generating the output value of the third sub-pixel in the third pixel column according to input values of two third sub-pixels corresponding to the third sub-pixel in the third pixel column.

For instance, the output value of the third sub-pixel in the third pixel column is generated by dividing, by two, the sum of the input values of the two third sub-pixels corresponding to the third sub-pixel in the third pixel column.

S1014: generating the output value of the second sub-pixel in the fourth pixel column according to input values of two second sub-pixels corresponding to the second sub-pixel in the fourth pixel column of the first sub-pixel group.

For instance, the output value of the second sub-pixel in the fourth pixel column is generated by dividing, by two, the sum of the input values of the two second sub-pixels corresponding to the second sub-pixel in the fourth pixel column of the first sub-pixel group.

S102: outputting the output value of the first sub-pixel in the first pixel column, the output values of the two second sub-pixels in the second pixel column, the output values of the third sub-pixels in the third pixel column, and the output value of the second sub-pixel in the fourth pixel column of the first sub-pixel group.

S103: generating output values of two first sub-pixels in the first pixel column, output values of two second sub-pixels in the second pixel column, an output value of a third sub-pixel in the third pixel column, and an output value of a second sub-pixel in the fourth pixel column of the second sub-pixel group.

In the embodiment, the step S103, for instance, includes the following steps S1031 to S1034.

S1031: generating the output value of each first sub-pixel in the first pixel column according to input values of two first sub-pixels corresponding to each first sub-pixel in the first pixel column of the second sub-pixel group.

For instance, the output value of each first sub-pixel in the first pixel column is generated by dividing, by two, the sum of the input values of the two first sub-pixels corresponding to each first sub-pixel in the first pixel column of the second sub-pixel group.

S1032: generating the output value of each second sub-pixel in the second pixel column according to an input value of a second sub-pixel corresponding to each second sub-pixel in the second pixel column of the second sub-pixel group.

For instance, the input value of the second sub-pixel corresponding to each second sub-pixel in the second pixel column of the second sub-pixel group is set to be the output value of each second sub-pixel in the second pixel column.

S1033: generating the output value of the third sub-pixel in the third pixel column according to input values of four third sub-pixels corresponding to the third sub-pixel in the third pixel column of the second sub-pixel group.

For instance, the output value of the third sub-pixel in the third pixel column is generated by dividing, by four, the sum of the input values of the four third sub-pixels corresponding to the third sub-pixel in the third pixel column of the second sub-pixel group.

S1034: generating the output value of the second sub-pixel in the fourth pixel column according to input values of two second sub-pixels corresponding to the second sub-pixel in the fourth pixel column of the second sub-pixel group.

For instance, the output value of the second sub-pixel in the fourth pixel column is generated by dividing, by two, the sum of the input values of the two second sub-pixels corresponding to the second sub-pixel in the fourth pixel column of the second sub-pixel group.

S104: outputting the output values of the two first sub-pixels in the first pixel column, the output values of the two second sub-pixels in the second pixel column, the output value of the third sub-pixel in the third pixel column, and the output value of the second sub-pixel in the fourth pixel column of the second sub-pixel group.

S105: generating output values of third sub-pixels in the first pixel column, an output value of a second sub-pixel in the second pixel column, an output value of a first sub-pixel in the third pixel column, and output values of two second sub-pixels in the fourth pixel column of the third sub-pixel group.

In the embodiment, the step S105, for instance, includes the following steps S1051 to S1054.

S1051: generating the output value of the third sub-pixel in the first pixel column according to input values of two third sub-pixels corresponding to the third sub-pixel in the first pixel column.

For instance, the output value of the third sub-pixel in the first pixel column is generated by dividing, by two, the sum of the input values of the two third sub-pixels corresponding to the third sub-pixel in the first pixel column.

S1052: generating the output value of the second sub-pixel in the second pixel column according to input values of two second sub-pixels corresponding to the second sub-pixel in the second pixel column of the third sub-pixel group.

For instance, the output value of the second sub-pixel in the second pixel column is generated by dividing, by two, the sum of the input values of the two second sub-pixels corresponding to the second sub-pixel in the second pixel column of the third sub-pixel group.

S1053: generating the output value of the first sub-pixel in the third pixel column according to input values of four first sub-pixels corresponding to the first sub-pixel in the third pixel column of the third sub-pixel group.

For instance, the output value of the first sub-pixel in the third pixel column is generated by dividing, by four, the sum of the input values of the four first sub-pixels corresponding to the first sub-pixel in the third pixel column of the third sub-pixel group.

S1054: generating the output value of each second sub-pixel in the fourth pixel column according to an input value of a second sub-pixel corresponding to each second sub-pixel in the fourth pixel column of the third sub-pixel group.

For instance, the input value of the second sub-pixel corresponding to each second sub-pixel in the fourth pixel column of the third sub-pixel group is set to be the output value of each second sub-pixel in the fourth pixel column.

S106: outputting the output values of the third sub-pixels in the first pixel column, the output value of the second sub-pixel in the second pixel column, the output value of the first sub-pixel in the third pixel column, and the output values of the two second sub-pixels in the fourth pixel column of the third sub-pixel group.

S107: generating an output value of a third sub-pixel in the first pixel column, an output value of a second sub-pixel in the second pixel column, output values of two first sub-pixels in the third pixel column, and output values of two second sub-pixels in the fourth pixel column of the fourth sub-pixel group.

In the embodiment, the step S107, for instance, includes the following steps S1071 to S1074.

S1071: generating the output value of the third sub-pixel in the first pixel column according to input values of four third sub-pixels corresponding to the third sub-pixel in the first pixel column of the fourth sub-pixel group.

For instance, the output value of the third sub-pixel in the first pixel column is generated by dividing, by four, the sum of the input values of the four third sub-pixels corresponding to the third sub-pixel in the first pixel column of the fourth sub-pixel group.

S1072: generating the output value of the second sub-pixel in the second pixel column according to input values of two second sub-pixels corresponding to the second sub-pixel in the second pixel column of the fourth sub-pixel group.

For instance, the output value of the second sub-pixel in the second pixel column is generated by dividing, by two, the sum of the input values of the two second sub-pixels corresponding to the second sub-pixel in the second pixel column of the fourth sub-pixel group.

S1073: generating the output value of each first sub-pixel in the third pixel column according to input values of four first sub-pixels corresponding to each first sub-pixel in the third pixel column of the fourth sub-pixel group.

For instance, the output value of each first sub-pixel in the third pixel column is generated by dividing, by four, the sum of the input values of the four first sub-pixels corresponding to each first sub-pixel in the third pixel column of the fourth sub-pixel group.

S1074: generating the output value of each second sub-pixel in the fourth pixel column according to an input value of a second sub-pixel corresponding to each second sub-pixel in the fourth pixel column of the fourth sub-pixel group.

For instance, the input value of the second sub-pixel corresponding to each second sub-pixel in the fourth pixel column of the fourth sub-pixel group is set to be the output value of each second sub-pixel in the fourth pixel column.

The sequence of the steps S1011 to S1014 may be randomly changed. The steps may also be performed simultaneously. No limitation will be given here. The sequence of the steps S1031 to S1034 may be randomly changed. The steps may also be performed simultaneously. No limitation will be given here. The sequence of the steps S1051 to S1054 may be randomly changed. The steps may also be performed simultaneously. No limitation will be given here. The sequence of the steps S1071 to S1074 may be randomly changed. The steps may also be performed simultaneously. No limitation will be given here.

The method for driving the display substrate, provided by the embodiment, is used for driving the display substrate provided by the first embodiment. The description on the display substrate may refer to the first embodiment.

In the technical proposal of the display substrate driven by the method for driving the display substrate, provided by the embodiment, each pixel group includes four sub-pixel groups and includes six first sub-pixels, twelve second sub-pixels, and six third sub-pixels. In the embodiment, the number of the first sub-pixels, the second sub-pixels and the third sub-pixels in each pixel group is reduced, so that the number of the sub-pixels in the whole display device can be reduced, and hence the difficulty in the manufacturing process of the display device and the cost can be reduced on the premise of ensuring that the display device obtains a high resolution.

The fifth embodiment of the present disclosure provides a method for driving a display substrate. The method is used for driving the display substrate provided by the second embodiment. The method may comprise the following steps.

S201: generating an output value of a first sub-pixel in the first pixel column, output values of two second sub-pixels in the second pixel column, an output value of a third sub-pixel in the third pixel column and an output value of a second sub-pixel in the fourth pixel column of the first sub-pixel group.

In the embodiment, the step S201, for instance, includes the following steps S2011 to S2014.

S2011: generating the output value of the first sub-pixel in the first pixel column according to input values of four first sub-pixels corresponding to the first sub-pixel in the first pixel column of the first sub-pixel group.

For instance, the output value of the first sub-pixel in the first pixel column is generated by dividing, by four, the sum of the input values of the four first sub-pixels corresponding to the first sub-pixel in the first pixel column of the first sub-pixel group.

S2012: generating the output value of each second sub-pixel in the second pixel column according to an input value of a second sub-pixel corresponding to each second sub-pixel in the second pixel column of the first sub-pixel group.

For instance, the input value of the second sub-pixel corresponding to each second sub-pixel in the second pixel column of the first sub-pixel group is set to be the output value of each second sub-pixel in the second pixel column.

S2013: generating the output value of the third sub-pixel in the third pixel column according to input values of four third sub-pixels corresponding to the third sub-pixel in the third pixel column.

For instance, the output value of the third sub-pixel in the third pixel column is generated by dividing, by four, the sum of the input values of the four third sub-pixels corresponding to the third sub-pixel in the third pixel column.

S2014: generating the output value of the second sub-pixel in the fourth pixel column according to input values of two second sub-pixels corresponding to the second sub-pixel in the fourth pixel column of the first sub-pixel group.

For instance, the output value of the second sub-pixel in the fourth pixel column is generated by dividing, by two, the sum of the input values of the two second sub-pixels corresponding to the second sub-pixel in the fourth pixel column of the first sub-pixel group.

S202: outputting the output value of the first sub-pixel in the first pixel column, the output values of the two second sub-pixels in the second pixel column, the output value of the third sub-pixel in the third pixel column, and the output value of the second sub-pixel in the fourth pixel column of the first sub-pixel group.

S203: generating output values of two first sub-pixels in the first pixel column, output values of two second sub-pixels in the second pixel column, an output value of a third sub-pixel in the third pixel column, and an output value of a second sub-pixel in the fourth pixel column of the second sub-pixel group.

In the embodiment, the step S203, for instance, includes the following steps S2031 to S2034.

S2031: generating the output value of each first sub-pixel in the first pixel column according to input values of two first sub-pixels corresponding to each first sub-pixel in the first pixel column of the second sub-pixel group.

For instance, the output value of each first sub-pixel in the first pixel column is generated by dividing, by two, the sum of the input values of the two first sub-pixels corresponding to each first sub-pixel in the first pixel column of the second sub-pixel group.

S2032: generating the output value of each second sub-pixel in the second pixel column according to an input value of a second sub-pixel corresponding to each second sub-pixel in the second pixel column of the second sub-pixel group.

For instance, the input value of the second sub-pixel corresponding to each second sub-pixel in the second pixel column of the second sub-pixel group is set to be the output value of each second sub-pixel in the second pixel column.

S2033: generating the output value of the third sub-pixel in the third pixel column according to input values of four third sub-pixels corresponding to the third sub-pixel in the third pixel column of the second sub-pixel group.

For instance, the output value of the third sub-pixel in the third pixel column is generated by dividing, by four, the sum of the input values of the four third sub-pixels corresponding to the third sub-pixel in the third pixel column of the second sub-pixel group.

S2034: generating the output value of the second sub-pixel in the fourth pixel column according to input values of two second sub-pixels corresponding to the second sub-pixel in the fourth pixel column of the second sub-pixel group.

For instance, the output value of the second sub-pixel in the fourth pixel column is generated by dividing, by two, the sum of the input values of the two second sub-pixels corresponding to the second sub-pixel in the fourth pixel column of the second sub-pixel group.

S204: outputting the output values of the two first sub-pixels in the first pixel column, the output values of the two second sub-pixels in the second pixel column, the output value of the third sub-pixel in the third pixel column, and the output value of the second sub-pixel in the fourth pixel column of the second sub-pixel group.

S205: generating an output value of a third sub-pixel in the first pixel column, an output value of a second sub-pixel in the second pixel column, an output value of a first sub-pixel in the third pixel column and output values of two second sub-pixels in the fourth pixel column of the third sub-pixel group.

In the embodiment, the step S205, for instance, includes the following steps S2051 to S2054.

S2051: generating the output value of the third sub-pixel in the first pixel column according to input values of four third sub-pixels corresponding to the third sub-pixel in the first pixel column.

For instance, the output value of the third sub-pixel in the first pixel column is generated by dividing, by four, the sum of the input values of the four third sub-pixels corresponding to the third sub-pixel in the first pixel column.

S2052: generating the output value of the second sub-pixel in the second pixel column according to input values of two second sub-pixels corresponding to the second sub-pixel in the second pixel column of the third sub-pixel group.

For instance, the output value of the second sub-pixel in the second pixel column is generated by dividing, by two, the sum of the input values of the two second sub-pixels corresponding to the second sub-pixel in the second pixel column of the third sub-pixel group.

S2053: generating the output value of the first sub-pixel in the third pixel column according to input values of four first sub-pixels corresponding to the first sub-pixel in the third pixel column of the third sub-pixel group.

For instance, the output value of the first sub-pixel in the third pixel column is generated by dividing, by four, the sum of the input values of the four first sub-pixels corresponding to the first sub-pixel in the third pixel column of the third sub-pixel group.

S2054: generating the output value of each second sub-pixel in the fourth pixel column according to an input value of a second sub-pixel corresponding to each second sub-pixel in the fourth pixel column of the third sub-pixel group.

For instance, the input value of the second sub-pixel corresponding to each second sub-pixel in the fourth pixel column of the third sub-pixel group is set to be the output value of each second sub-pixel in the fourth pixel column.

S206: outputting the output value of the third sub-pixel in the first pixel column, the output value of the second sub-pixel in the second pixel column, the output value of the first sub-pixel in the third pixel column and the output values of the two second sub-pixels in the fourth pixel column of the third sub-pixel group.

S207: generating an output value of a third sub-pixel in the first pixel column, an output value of a second sub-pixel in the second pixel column, output values of two first sub-pixels in the third pixel column and output values of two second sub-pixels in the fourth pixel column of the fourth sub-pixel group.

In the embodiment, the step S207, for instance, includes the following steps S2071 to S2074.

S2071: generating the output value of the third sub-pixel in the first pixel column according to input values of four third sub-pixels corresponding to the third sub-pixel in the first pixel column of the fourth sub-pixel group.

For instance, the output value of the third sub-pixel in the first pixel column is generated by dividing, by four, the sum of the input values of the four third sub-pixels corresponding to the third sub-pixel in the first pixel column of the fourth sub-pixel group.

S2072: generating the output value of the second sub-pixel in the second pixel column according to input values of two second sub-pixels corresponding to the second sub-pixel in the second pixel column of the fourth sub-pixel group.

For instance, the output value of the second sub-pixel in the second pixel column is generated by dividing, by two, the sum of the input values of the two second sub-pixels corresponding to the second sub-pixel in the second pixel column of the fourth sub-pixel group.

S2073: generating the output value of each first sub-pixel in the third pixel column according to input values of four first sub-pixels corresponding to each first sub-pixel in the third pixel column of the fourth sub-pixel group.

For instance, the output value of each first sub-pixel in the third pixel column is generated by dividing, by four, the sum of the input values of the four first sub-pixels corresponding to each first sub-pixel in the third pixel column of the fourth sub-pixel group.

S2074: generating the output value of each second sub-pixel in the fourth pixel column according to an input value of a second sub-pixel corresponding to each second sub-pixel in the fourth pixel column of the fourth sub-pixel group.

For instance, the input value of the second sub-pixel corresponding to each second sub-pixel in the fourth pixel column of the fourth sub-pixel group is set to be the output value of each second sub-pixel in the fourth pixel column.

The sequence of the steps S2011 to S2014 may be randomly changed. The steps may also be performed simultaneously. No limitation will be given here. The sequence of the steps S2031 to S2034 may be randomly changed. The steps may also be performed simultaneously. No limitation will be given here. The sequence of the steps S2051 to S2054 may be randomly changed. The steps may also be performed simultaneously. No limitation will be given here. The sequence of the steps S2071 to S2074 may be randomly changed. The steps may also be performed simultaneously. No limitation will be given here.

The method for driving the display substrate, provided by the embodiment, is used for driving the display substrate provided by the second embodiment. The description on the display substrate may refer to the second embodiment.

In the technical proposal of the display substrate driven by the method for driving the display substrate, provided by the embodiment, each pixel group includes four sub-pixel groups and includes six first sub-pixels, twelve second sub-pixels, and four third sub-pixels. In the embodiment, the number of the first sub-pixels, the second sub-pixels and the third sub-pixels in each pixel group is reduced, so that the number of the sub-pixels in the whole display device can be reduced, and hence the difficulty in the manufacturing process of the display device and the cost can be reduced on the premise of ensuring that the display device obtains a high resolution.

The foregoing is only the preferred embodiments of the present disclosure and not intended to limit the scope of protection of the present disclosure. The scope of protection of the present disclosure should be defined by the appended claims.

The application claims priority to the Chinese patent application No. 201510079890.4, filed Feb. 13, 2015, the disclosure of which is incorporated herein by reference as part of the application.

The invention claimed is:

1. A display substrate, comprising repeatedly arranged pixel groups, wherein each pixel group includes a first sub-pixel group, a second sub-pixel group, a third sub-pixel group and a fourth sub-pixel group; each of the first sub-pixel group, the second sub-pixel group, the third sub-pixel group and the fourth sub-pixel group includes four pixel columns;

the first pixel column in the first sub-pixel group is provided with a first sub-pixel; two second sub-pixels in the second pixel column of the first sub-pixel group are arranged in sequence; the third pixel column in the first sub-pixel group is provided with a third sub-pixel; the fourth pixel column in the first sub-pixel group is provided with one second sub-pixel, in which both the first sub-pixel in the first pixel column and the second sub-pixel in the fourth pixel column correspond the two second sub-pixels in the second pixel column;

two first sub-pixels in the first pixel column of the second sub-pixel group are arranged in sequence; two second sub-pixels in the second pixel column of the second sub-pixel group are arranged in sequence; the third pixel column in the second sub-pixel group is provided with one third sub-pixel; the fourth pixel column in the second sub-pixel group is provided with one second sub-pixel, in which both the third sub-pixel in the third pixel column and the second sub-pixel in the fourth pixel column correspond to the two second sub-pixels in the second pixel column;

the first pixel column in the third sub-pixel group is provided with third sub-pixels; the second pixel column in the third sub-pixel group is provided with one second sub-pixel; the third pixel column in the third sub-pixel group is provided with one first sub-pixel; two second sub-pixels in the fourth pixel column of the third sub-pixel group are arranged in sequence, in which both the second sub-pixel in the second pixel column and the first sub-pixel in the third pixel column correspond to the two second sub-pixels in the fourth pixel column;

the first pixel column in the fourth sub-pixel group is provided with a third sub-pixel; the second pixel column in the fourth sub-pixel group is provided with one second sub-pixel; two first sub-pixels in the third pixel column of the fourth sub-pixel group are arranged in sequence; and two second sub-pixels in the fourth pixel column of the fourth sub-pixel group are arranged in sequence, in which both the third sub-pixel in the first pixel column and the second sub-pixel in the second pixel column correspond to the two first sub-pixels in the third pixel column.

2. The display substrate according to claim 1, wherein, for each pixel group, the first sub-pixel group and the second sub-pixel group are arranged side by side; the third sub-pixel group and the fourth sub-pixel group are arranged side by side; the pixel columns in the first sub-pixel group are provided in same columns with the pixel columns in the third sub-pixel group; and the pixel columns in the second sub-pixel group are provided in same columns with the pixel columns in the fourth sub-pixel group.

3. The display substrate according to claim 1, wherein the third pixel column in the first sub-pixel group is provided with one third sub-pixel, and the third sub-pixel in the third pixel column of the first sub-pixel group corresponds to the two second sub-pixels in the second pixel column; or the third pixel column in the first sub-pixel group is provided with two third sub-pixels.

4. The display substrate according to claim 3, wherein when the third pixel column in the first sub-pixel group is provided with one third sub-pixel, the first sub-pixel in the first pixel column, the third sub-pixel in the third pixel column and the second sub-pixel in the fourth pixel column of the first sub-pixel group are arranged in a same pixel row as the third sub-pixel in the third pixel column and the second sub-pixel in the fourth pixel column of the second sub-pixel group; and when the third pixel column of the first sub-pixel group is provided with two third sub-pixels, the first sub-pixel in the first pixel column and the second sub-pixel in the fourth pixel column of the first sub-pixel group are arranged in a same pixel row as the third sub-pixel in the third pixel column and the second sub-pixel in the fourth pixel column of the second sub-pixel group.

5. The display substrate according to claim 1, wherein the first pixel column in the third sub-pixel group is provided with one third sub-pixel, and the first sub-pixel in the third pixel column of the third sub-pixel group corresponds to the two second sub-pixels in the second pixel column; or the first pixel column in the third sub-pixel group is provided with two third sub-pixels.

6. The display substrate according to claim 5, wherein when the first pixel column in the third sub-pixel group is provided with one third sub-pixel, the third sub-pixel in the first pixel column, the second sub-pixel in the second pixel column and the first sub-pixel in the third pixel column of the third sub-pixel group are arranged in a same pixel row as the third sub-pixel in the first pixel column and the second sub-pixel in the second pixel column of the fourth sub-pixel group; or when the first pixel column in the third sub-pixel group is provided with two third sub-pixels, the second sub-pixel in the second pixel column and the first sub-pixel in the third pixel column of the third sub-pixel group arranged in a same pixel row as the third sub-pixel in the first pixel column and the second sub-pixel in the second pixel column of the fourth sub-pixel group.

7. A display device, comprising: the display substrate according to claim 1.

8. A method for driving a display substrate for driving the display substrate according to claim 1, comprising:

generating an output value of the first sub-pixel in the first pixel column, output values of two second sub-pixels in the second pixel column, output values of the third sub-pixel in the third pixel column, and an output value of a second sub-pixel in the fourth pixel column of the first sub-pixel group, and outputting the output value of the first sub-pixel in the first pixel column, the output values of the two second sub-pixels in the second pixel column, the output values of the third sub-pixel in the third pixel column, and the output value of the second sub-pixel in the fourth pixel column of the first sub-pixel group;

generating output values of two first sub-pixels in the first pixel column, output values of two second sub-pixels in the second pixel column, an output value of the third sub-pixel in the third pixel column, and an output value of the second sub-pixel in the fourth pixel column of the second sub-pixel group, and outputting the output value of the two first sub-pixels in the first pixel column, the output values of the two second sub-pixels in the second pixel column, the output value of the third sub-pixel in the third pixel column and the output value of the second sub-pixel in the fourth pixel column of the second sub-pixel group;

generating output values of third sub-pixels in the first pixel column, an output value of the second sub-pixel in the second pixel column, an output value of the first sub-pixel in the third pixel column, and output values of two second sub-pixels in the fourth pixel column of the third sub-pixel group, and outputting the output values of the third sub-pixels in the first pixel column, the output value of the second sub-pixel in the second pixel column, the output value of the first sub-pixel in the third pixel column, and the output values of the two second sub-pixels in the fourth pixel column of the third sub-pixel group; and generating an output value of the third sub-pixel in the first pixel column, an output value of the second sub-pixel in the second pixel column, an output value of two first sub-pixels in the third pixel column, and output values of two second sub-pixels in the fourth pixel column of the fourth sub-pixel group, and outputting the output value of the third sub-pixel in the first pixel column, the output value of the second sub-pixel in the second pixel column, the output value of the two first sub-pixels in the third pixel column, and the output values of the two second sub-pixels in the fourth pixel column of the fourth sub-pixel group.

9. The method for driving the display substrate according to claim 8, wherein generating of the output value of the two first sub-pixels in the first pixel column, the output values of the two second sub-pixels in the second pixel column, the output value of the third sub-pixel in the third pixel column and the output value of the second sub-pixel in the fourth pixel column of the second sub-pixel group includes:

generating the output value of each first sub-pixel in the first pixel column according to input values of two first sub-pixels corresponding to each first sub-pixel in the first pixel column of the second sub-pixel group;

generating the output value of each second sub-pixel in the second pixel column according to an input value of a second sub-pixel corresponding to each second sub-pixel in the second pixel column of the second sub-pixel group;

generating the output value of the third sub-pixel in the third pixel column according to input values of four third sub-pixels corresponding to the third sub-pixel in the third pixel column of the second sub-pixel group; and generating the output value of the second sub-pixel in the fourth pixel column according to input values of two second sub-pixels corresponding to the second sub-pixel in the fourth pixel column of the second sub-pixel group.

10. The method for driving the display substrate according to claim 9, wherein generating of the output value of each first sub-pixel in the first pixel column according to the input values of the two first sub-pixels corresponding to each first sub-pixel in the first pixel column of the second sub-pixel group includes: generating the output value of each first sub-pixel in the first pixel column by dividing, by two, a sum of the input values of the two first sub-pixels corresponding to each first sub-pixel in the first pixel column of the second sub-pixel group;

generating of the output value of each second sub-pixel in the second pixel column according to the input value of the second sub-pixel corresponding to each second sub-pixel in the second pixel column of the second sub-pixel group includes: setting the input value of the second sub-pixel corresponding to each second sub-pixel in the second pixel column of the second sub-pixel group to be the output value of each second sub-pixel in the second pixel column;

generating of the output value of the third sub-pixel in the third pixel column according to the input values of the four third sub-pixels corresponding to the third sub-pixel in the third pixel column of the second sub-pixel group includes: generating the output value of the third sub-pixel in the third pixel column by dividing, by four, a sum of the input values of the four third sub-pixels corresponding to the third sub-pixel in the third pixel column of the second sub-pixel group; and generating of the output value of the second sub-pixel in the fourth pixel column according to the input values of the two second sub-pixels corresponding to the second sub-pixel in the fourth pixel column of the second sub-pixel group includes: generating the output value of the second sub-pixel in the fourth pixel column by dividing, by two, a sum of the input values of the two second sub-pixels corresponding to the second sub-pixel in the fourth pixel column of the second sub-pixel group.

11. The method for driving the display substrate according to claim 8, wherein generating of the output values of the third sub-pixels in the first pixel column, the output value of the second sub-pixel in the second pixel column, the output value of the first sub-pixel in the third pixel column and the output values of the two second sub-pixels in the fourth pixel column of the third sub-pixel group includes:

when the first pixel column in the third sub-pixel group is provided with one third sub-pixel, generating the output value of the third sub-pixel in the first pixel column according to input values of four third sub-pixels corresponding to the third sub-pixel in the first pixel column; or when the first pixel column in the third sub-pixel group is provided with two third sub-pixels, generating the output value of the third sub-pixel in the first pixel column according to input values of two third sub-pixels corresponding to the third sub-pixel in the first pixel column;

generating the output value of the second sub-pixel in the second pixel column according to input values of two second sub-pixels corresponding to the second sub-pixel in the second pixel column of the third sub-pixel group;

generating the output value of the first sub-pixel in the third pixel column according to input values of four first sub-pixels corresponding to the first sub-pixel in the third pixel column of the third sub-pixel group; and generating the output value of each second sub-pixel in the fourth pixel column according to an input value of a second sub-pixel corresponding to each second sub-pixel in the fourth pixel column of the third sub-pixel group.

12. The method for driving the display substrate according to claim 11, wherein generating of the output value of the third sub-pixel in the first pixel column according to the input values of the four third sub-pixels corresponding to the third sub-pixel in the first pixel column, when the first pixel column in the third sub-pixel group is provided with one third sub-pixel, includes: generating the output value of the third sub-pixel in the first pixel column by dividing, by four, a sum of the input values of the four third sub-pixels corresponding to the third sub-pixel in the first pixel column; or generating of the output value of the third sub-pixel in the first pixel column according to the input values of the two third sub-pixels corresponding to the third sub-pixel in the first pixel column, when the third pixel column in the third sub-pixel group is provided with two third sub-pixels, includes: generating the output value of the third sub-pixel in the first pixel column by dividing, by two, a sum of the input values of the two third sub-pixels corresponding to the third sub-pixel in the first pixel column;

generating of the output value of the second sub-pixel in the second pixel column according to the input values of the two second sub-pixels corresponding to the second sub-pixel in the second pixel column of the third sub-pixel group includes: generating the output value of the second sub-pixel in the second pixel column by dividing, by two, a sum of the input values of the two second sub-pixels corresponding to the second sub-pixel in the second pixel column of the third sub-pixel group;

generating of the output value of the first sub-pixel in the third pixel column according to the input values of the four first sub-pixels corresponding to the first sub-pixel in the third pixel column of the third sub-pixel group includes: generating the output value of the first sub-pixel in the third pixel column by dividing, by four, a sum of the input values of the four first sub-pixels corresponding to the first sub-pixel in the third pixel column of the third sub-pixel group; and generating of the output value of each second sub-pixel in the fourth pixel column according to the input value of the second sub-pixel corresponding to each second sub-pixel in the fourth pixel column of the third sub-pixel group includes: setting the input value of the second sub-pixel corresponding to each second sub-pixel in the fourth pixel column of the third sub-pixel group to be the output value of each second sub-pixel in the fourth pixel column.

13. The method for driving the display substrate according to claim 8, wherein generating of the output value of the third sub-pixel in the first pixel column, the output value of the second sub-pixel in the second pixel column, the output value of the two first sub-pixels in the third pixel column and the output values of the two second sub-pixels in the fourth pixel column of the fourth sub-pixel group includes:

generating the output value of the third sub-pixel in the first pixel column according to input values of four third sub-pixels corresponding to the third sub-pixel in the first pixel column of the fourth sub-pixel group;

generating the output value of the second sub-pixel in the second pixel column according to input values of two second sub-pixels corresponding to the second sub-pixel in the second pixel column of the fourth sub-pixel group;

generating the output value of each first sub-pixel in the third pixel column according to input values of four first sub-pixels corresponding to each first sub-pixel in the third pixel column of the fourth sub-pixel group; and generating the output value of each second sub-pixel in the fourth pixel column according to an input value of a second sub-pixel corresponding to each second sub-pixel in the fourth pixel column of the fourth sub-pixel group.

14. The method for driving the display substrate according to claim 13, wherein generating of the output value of the third sub-pixel in the first pixel column according to the input values of the four third sub-pixels corresponding to the third sub-pixel in the first pixel column of the fourth sub-pixel group includes: generating the output value of the third sub-pixel in the first pixel column by dividing, by four, a sum of the input values of the four third sub-pixels corresponding to the third sub-pixel in the first pixel column of the fourth sub-pixel group;

generating of the output value of the second sub-pixel in the second pixel column according to the input values of the two second sub-pixels corresponding to the second sub-pixel in the second pixel column of the fourth sub-pixel group includes: generating the output value of the second sub-pixel in the second pixel column by dividing, by two, a sum of the input values of the two second sub-pixels corresponding to the second sub-pixel in the second pixel column of the fourth sub-pixel group;

generating of the output value of each first sub-pixel in the third pixel column according to the input values of the four first sub-pixels corresponding to each first sub-pixel in the third pixel column of the fourth sub-pixel group includes: generating the output value of each first sub-pixel in the third pixel column by dividing, by four, a sum of the input values of the four first sub-pixels corresponding to each first sub-pixel in the third pixel column of the fourth sub-pixel group; and generating of the output value of each second sub-pixel in the fourth pixel column according to the input value of the second sub-pixel corresponding to each second sub-pixel in the fourth pixel column of the fourth sub-pixel group includes: setting the input value of the second sub-pixel corresponding to each second sub-pixel in the fourth pixel column of the fourth sub-pixel group to be the output value of each second sub-pixel in the fourth pixel column.

15. The display substrate according to claim 1, wherein all of the first sub-pixels have same one color, all of the second sub-pixels have same one color, and all of the third sub-pixels have same one color.

16. The display substrate according to claim 1, wherein each pixel group only comprises the first sub-pixels, the second sub-pixels, and the third sub-pixels.

17. The display substrate according to claim 1, wherein the first sub-pixels have same one length along an extension direction of the first pixel column;

the second sub-pixels have same one length along the extension direction of the first pixel column; and the third sub-pixels have same one length along the extension direction of the first pixel column.

18. The method for driving the display substrate according to claim 8, wherein generating of the output value of the first sub-pixel in the first pixel column, the output values of the two second sub-pixels in the second pixel column, the output values of the third sub-pixels in the third pixel column and the output value of the second sub-pixel in the fourth pixel column of the first sub-pixel group includes:

generating the output value of the first sub-pixel in the first pixel column according to input values of four first sub-pixels corresponding to the first sub-pixel in the first pixel column of the first sub-pixel group;

generating the output value of each second sub-pixel in the second pixel column according to the input value of the second sub-pixel corresponding to each second sub-pixel in the second pixel column of the first sub-pixel group;

when the third pixel column in the first sub-pixel group is provided with one third sub-pixel, generating the output value of the third sub-pixel in the third pixel column according to input values of four third sub-pixels corresponding to the third sub-pixel in the third pixel column; or when the third pixel column in the first sub-pixel group is provided with two third sub-pixels, generating the output value of the third sub-pixel in the third pixel column according to input values of two third sub-pixels corresponding to the third sub-pixels in the third pixel column; and generating the output value of the second sub-pixel in the fourth pixel column according to input values of two second sub-pixels corresponding to the second sub-pixel in the fourth pixel column of the first sub-pixel group.

19. The method for driving the display substrate according to claim 18, wherein generating of the output value of the first sub-pixel in the first pixel column according to the input values of the four first sub-pixels corresponding to the first sub-pixel in the first pixel column of the first sub-pixel group includes: generating the output value of the first sub-pixel in the first pixel column by dividing, by four, a sum of the input values of the four first sub-pixels corresponding to the first sub-pixel in the first pixel column of the first sub-pixel group;

generating of the output value of each second sub-pixel in the second pixel column according to the input value of the second sub-pixel corresponding to each second sub-pixel in the second pixel column of the first sub-pixel group includes: setting the input value of the second sub-pixel corresponding to each second sub-pixel in the second pixel column of the first sub-pixel group to be the output value of each second sub-pixel in the second pixel column;

generating of the output value of the third sub-pixel in the third pixel column according to the input values of the four third sub-pixels corresponding to the third sub-pixel in the third pixel column, when the third pixel column in the first sub-pixel group is provided with one third sub-pixel, includes: generating the output value of the third sub-pixel in the third pixel column by dividing, by four, a sum of the input values of the four third sub-pixels corresponding to the third sub-pixel in the third pixel column; or generating of the output value of the third sub-pixel in the third pixel column according to the input values of the two third sub-pixels corresponding to the third sub-pixel in the third pixel column, when the third pixel column in the first sub-pixel group is provided with two third sub-pixels, includes: generating the output value of the third sub-pixel in the third pixel column by dividing, by two, a sum of the input values of the two third sub-pixels corresponding to the third sub-pixel in the third pixel column; and generating of the output value of the second sub-pixel in the fourth pixel column according to the input values of the two second sub-pixels corresponding to the second sub-pixel in the fourth pixel column of the first sub-pixel group includes: generating the output value of the second sub-pixel in the fourth pixel column by dividing, by two, a sum of the input values of the two second sub-pixels corresponding to the second sub-pixel in the fourth pixel column of the first sub-pixel group.

* * * * *